United States Patent [19]

Tanemura et al.

[11] Patent Number: 4,556,633

[45] Date of Patent: Dec. 3, 1985

[54] SILVER HALIDE COLOR LIGHT-SENSITIVE MATERIALS

[75] Inventors: Hatsumi Tanemura; Toshinao Ukai; Masaki Okazaki; Naoyasu Deguchi; Munehisa Fujita; Kiyohiko Yamamuro, all of Kanagawa, Japan

[73] Assignee: Fuji Photo Film Co., Ltd., Kanagawa, Japan

[21] Appl. No.: 702,754

[22] Filed: Feb. 19, 1985

[30] Foreign Application Priority Data

Feb. 17, 1984 [JP] Japan ..... 59-28134

[51] Int. Cl.[4] ..... G03C 1/28

[52] U.S. Cl. ..... 430/573; 430/576; 430/578; 430/592; 430/567

[58] Field of Search ..... 430/573, 576, 578, 592, 430/567

[56] References Cited

U.S. PATENT DOCUMENTS

| | | | |
|---|---|---|---|
| 2,704,718 | 3/1955 | Jones | 430/573 |
| 4,138,266 | 2/1979 | Hinata et al. | 430/573 |
| 4,199,360 | 4/1980 | Hinata et al. | 430/576 |

*Primary Examiner*—J. Travis Brown

*Attorney, Agent, or Firm*—Sughrue, Mion, Zinn Macpeak & Seas

[57] ABSTRACT

Silver halide color light-sensitive materials which contain a compound having a repeating unit represented by general formula (I) and a compound represented by general formula (II):

(I)

wherein $R_1$ represents —OR, —SR or wherein R and R′ each represents a hydrogen atom, or alkyl group, a hydroxyalkyl group, a sulfoalkyl group (or a salt thereof), a carboxyalkyl group (for a salt thereof), an aralkyl group, an aryl group, or a cycloalkyl group, or R and R′ may form an alkylene group or an —O— containing alkylene ring together; $R_2$, $R_3$, $R_4$ and $R_5$ each represents a hydrogen atom or an alkyl group; $Y_1$, $Y_2$, $Y_3$ and $Y_4$ each represents a polymethylene group, an arylene group, or a cycloalkylene group, Z represents —O—, —$SO_2$— or —$CH_2$—; and l and m each represents 0 or 1;

(II)

$(Z_1)_{n-1}^{\ominus}$ wherein $R_6$ represents a hydrogen atom, an alkyl group; $R_7$ and $R_8$, which may be identical or different, each represents an alkyl group, or an aryl group, but at least one of $R_7$ and $R_8$ is an alkyl group having an acid substituent; D and E, which may be identical or different, each represents a hydrogen atom, a halogen atom, an alkyl group, a hydroxyl grup, an alkoxy group, an acyl group, an acyloxy group, an alkoxycarbonyl group, a carbamoyl group, a sulfamoyl group, a cyano group, a carboxyl group, an sulfo group, a trifluoromethyl group, a phenyl group or a benzene condensed ring, but at least one of D and E represents a hydroxyl group, an alkoxy group, an alkoxycarbonyl group or a carboxyl group; $Z_1$ represents an anion; and n represents 1 or 2, but n represents 1 when the dye forms an inner salt; the light-sensitive materials improve sensitization processing aptitude.

11 Claims, No Drawings

SILVER HALIDE COLOR LIGHT-SENSITIVE MATERIALS

FIELD OF THE INVENTION

The present invention relates to color photographic light-sensitive materials and, particularly, to the art of improving sensitization processing aptitude.

BACKGROUND OF THE INVENTION

Color photographic light-sensitive materials generally comprise at least two silver halide emulsions having each a different color sensitive property (the term "color sensitive property" means the property of being sensitive to any light of three regions in the visible spectrum, namely, red, green and blue) on a base, wherein each layer contains a silver halide emulsion and a dye forming coupler, namely, a compound capable of coloring in color development processing by coupling with an oxidation product of an aromatic primary amine developing agent (for example, phenylenediamine derivatives or aminophenol derivatives, etc.).

Sometimes, photographic light-sensitive materials are used under conditions of very low exposure amount. For example, there is the condition of taking a photograph of athletic sports which requires a high shutter speed or a photograph of the stage in a dark theater. In the case of taking such photographs, photographic light-sensitive materials having high sensitivity are required, and a high sensitization of light-sensitive materials and an increase of sensitivity by processing are carried out. The increase of sensitivity by processing is called, generally, "sensitization processing," which is carried out by changing the composition of the developing solution for standard processing, raising the development temperature or prolonging the development time.

However, the prior photographic light-sensitive materials do not always have sufficient sensitization processing aptitude, and also have the following problems:

(1) in the case of carrying out sensitization processing, the degree of increase of sensitivity from that of standard processing (hereinafter referred to as "width of sensitization") is insufficient, (2) in light-sensitive materials in which the emulsion layer is divided into a high speed layer and a low speed layer each of which has the same color sensitivity, tone (gradation) is different from that obtained by standard processing when the layers are subjected to sensitization processing, because the width of sensitization is different in both layers, or (3) particularly, in color light-sensitive materials, when they are subjected to sensitization processing, deterioration of color balance occurs, because the widths of sensitization of the red-sensitive layer, the green-sensitive layer and the blue-sensitive layer are different from one another.

Therefore, in order to improve the sensitization processing aptitude of, particularly, color photographic light-sensitive materials, it is necessary to develop silver halide photographic emulsions having a sufficiently large width of sensitization and to develop an art of exactly controlling the width of sensitization over a wide range.

The present invention has been developed to meet such technical requirements, and an object of the present invention is to provide color photographic light-sensitive materials having improved sensitization processing aptitude and to provide an art of controlling the width of sensitization arbitrarily in a wide range.

In order to control the width of sensitization arbitrarily, it is necessary to have a means for expanding the width and a means for reducing the width. Sensitization wavelengths of silver halide range up to blue light, and a spectral sensitization technique using the so-called sensitizing dyes is well known in the field of the art as a means of expanding sensitivity to a longer wavelength range. As a result of studies by the present inventors, it has been found that the sensitizing dye not only shows spectrum sensitization but also has a large influence upon sensitization processing aptitude. Namely, in a silver halide emulsion using a certain kind of sensitizing dye, the width of sensitization in the case of sensitization processing is large and, in a silver halide emulsion using another kind of sensitizing dye, the width of sensitization is small. Therefore, it has been expected that the width of sensitization in silver halide emulsions sensitized with the former sensitizing dyes can be controlled arbitrarily over a wide range, if combined with a substance which suppressively serves for development. However, the substance which suppressively serves for development is that which is effective only in the case of sensitization processing, and it is preferred that the substance does not show an inhibiting action in the case of standard processing. Namely, it is necessary that the substance acts to reduce the width of sensitization by use with a sensitizing dye but does not greatly reduce photographic sensitivity in standard processing or does not greatly change gradation. Thus, it is very difficult to find such a substance.

SUMMARY OF THE INVENTION

As a result of earnest studies in this area, the present inventors hve found that the above object can be attained when a compound having a repeating unit represented by general formula (I) which is a substance which suppressively serves for development is combined with a red-sensitive silver halide emulsion spectrally sensitized with a sensitizing dye represented by general formula (II) in the light-sensitive layer.

Specifically, the present invention provides silver halide color light-sensitive materials which contain a compound having a repeating unit represented by general formula (I) and a compound represented by general formula (II):

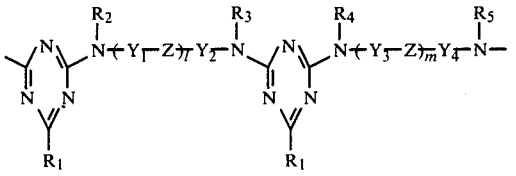

(I)

wherein $R_1$ represents —OR, —SR or

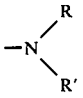

wherein R and R′ each represents a hydrogen atom, an alkyl group, a hydroxyalkyl group, a sulfolkyl group (or a salt thereof), a carboxyalkyl group (or a salt thereof), an aralkyl group, an aryl group or a cycloalkyl group, or R and R′ may be bonded to form an alkylene ring or an —O— containing alkylene ring; $R_2$, $R_3$, $R_4$ and $R_5$ each represents a hydrogen atom or an alkyl group; $Y_1$, $Y_2$, $Y_3$ and $Y_4$ each represents a polymethylene group, an arylene group or a cycloalkylene group; Z represents —O—, $—SO_2—$ or $—CH_2—$; and l and m each represents 0 or 1;

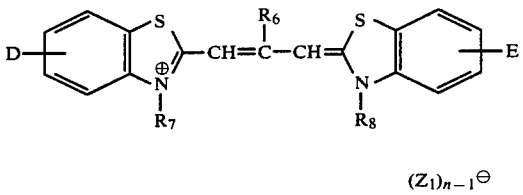

(II)

wherein $R_6$ represents a hydrogen atom or an alkyl group; $R_7$ and $R_8$, which may be identical or different, each represents an alkyl group or an aryl group, but at least one of $R_7$ and $R_8$ is an alkyl group having an acid substituent; D and E, which may be identical or different, each represents a hydrogen atom, a halogen atom, an alkyl group, a hydroxyl group, an alkoxy group, an acyl group, an acyloxy group, an alkoxycarbonyl group, a carbamoyl group, a sulfamoyl group, a cyano group, a carboxyl group, a sulfo group, a trifluoromethyl group, a phenyl group or a benzene condensed ring, but at least one of D and E represents a hydroxyl group, an alkoxy group, an alkoxycarbonyl group or a carboxyl group; $Z_1$ represents an anion; and n represents 1 or 2, but n=1 when the dye forms an inner salt.

DETAILED DESCRIPTION OF THE INVENTION

As emulsion grains in the present invention, surface low iodine type silver iodobromide is preferable. Further, when iodine ion in an amount of $10^{-7}$ to $10^{-2}$ mol per mol of silver halide is incorporated into the surface or subsurface area of the grains at a depth of up to 200 Å by adsorption or halogen conversion, the above object can be attained with providing a higher red-sensitivity.

In the present invention, the surface low iodine type emulsion means an emulsion comprising silver iodobromide grains wherein the iodine content of the surface part of the grains is lower than that of the inner part of the grains. In greater detail, it is a silver iodobromide emulsion having an iodine content of 1 to 10% by mol (the whole grain) wherein a peak originating from the high iodine layer is observed by X-ray diffractiometry and the surface iodine content measured by the XPS method (X-ray photoelectric spectrophotometry) is 0.5 to 8% by mol.

Preferably, the emulsion is a silver iodobromide emulsion having an iodine content of 1.5 to 5% by mol, wherein a peak originating from the high iodine layer and that originating from the low iodine layer are observed by X-ray diffractiometry and the surface iodine content measured by the XPS method (X-ray photoelectric spectrophotometry) is 1 to 3.5% by mol.

The above described XPS method is well known, and the iodine content can be easily measured by this method. This method has been described in detail in P. M. Kelly and M. G. Mason, *J. Appl. Physics*, 47 (11), 4721–4725 (1976).

In the present invention, the iodine content incorporated in the surface or subsurface area at a depth of up to 200 Å of the grain by adsorption or halogen conversion, per mol of silver halide, can be measured as follows.

First, the amount of iodine contained in the surface or subsurface area to up to 200 Å from the surface is regarded as A mols per mol of silver halide. Then, on the assumption that the iodine concentration in the position of 200 Å from the surface is kept constant to the surface, the amount of iodine contained in the surface or subsurface area is regarded as B mols per mol of silver halide. The molar value (A−B) is determined as the iodine content incorporated in the surface or subsurface area at a depth of up to 200 Å in the grain by adsorption or halogen conversion, per mol of silver halide.

The distribution of iodine concentration towards the inside of the grain from the surface of the grain can be determined by a method described in the above described P. M. Kelly and M. G. Mason, *J. Appl. Physics*, 47 (11), 4721–4725 (1976), and the surface area of the grain can be determined by a BET method. From both values, the value of (A−B) can be easily determined. The above described BET method is well known and described in detail in *Jikken Kagaku Koza* 7, Kaimenkagaku (*Surface Chemistry*), edited by Japan Chemical Society, Maruzen Publishing Co. (1968), p. 490.

A method of inhibiting fog by adding a compound having a repeating unit represented by general formula (I) alone to the sensitive layer has been described in Japanese Patent Publication No. 15471/71, but the Japanese Patent Publication only discloses the effect of the above described compound alone, and there is no description with respect to improvement of sensitization processing aptitude. Accordingly, the above described prior invention is quite different from the present invention.

The compounds having the repeating unit represented by general formula (I) are described in more detail below.

In general formula (I), the aryl group represented by R and R′ includes an unsubstituted and substituted aryl group. The polymethylene group represented by $Y_1$, $Y_2$, $Y_3$ and $Y_4$ includes an unsubstituted and substituted polymethylene group. The arylene group represented by $Y_1$, $Y_2$, $Y_3$ and $Y_4$ also includes an unsubstituted and substituted arylene group.

In general formula (I), the following substitutents are preferably used in the present invention.

That is, $R_1$ represents —OR, —SO or

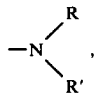

R and R′ each represents a hydrogen atom, an alkyl group having 1 to 12 carbon atoms (for example, a methyl group, an ethyl group, a propyl group, an octyl group, a decyl group, a dodecyl group, a 2-methylpropyl group, a 3,3-dimethylbutyl group, etc.), a hydroxyalkyl group having 1 to 12 carbon atoms in the alkyl moiety (for example, a 2-hydroxyethyl group, a 3-hydroxypropyl group, a 6-hydroxyhexyl group, etc.), a sulfoalkyl group or a salt thereof having 1 to 12 carbon atoms in the alkyl moiety (for example, a 2-sulfoethyl group, a 3-sulfopropyl group, a 3-sulfobutyl group, a 4-sulfobutyl group, a sodium-, potassium- and triethylamine-salt of the above groups, etc.), a carboxyalkyl group or a salt thereof having 1 to 12 carbon atoms in the alkyl moiety (for example, a 2-carboxyethyl group, a 3-carboxypropyl group, etc.), an aralkyl group (for example, a benzyl group, a 2-phenylethyl group, a 3-phenylpropyl group, etc.), an unsubstituted aryl group having 6 to 12 carbon atoms (for example, a phenyl group, a naphthyl group, etc.), a substituted aryl group having 6 to 12 carbon atoms in the aryl moiety (examples of substituents include a sulfo group (or a salt thereof), a carboxyl group (or a salt thereof), an alkyl group having 1 to 4 carbon atoms (for example, a methyl group, an ethyl group, a propyl group, a butyl group, etc.), an alkoxy group having 1 to 4 carbon atoms (for example, a methoxy group, an ethoxy group, a butoxy group, etc.), and a halogen atom (for example, a chlorine atom, a bromine atom, etc.)) or a cycloalkyl group (for example, a cyclopentyl group, a cyclohexyl group, etc.).

$R_2$, $R_3$, $R_4$ and $R_5$ each represents a hydrogen atom or an alkyl group having 1 to 4 carbon atoms (for example, a methyl group, an ethyl group, a propyl group, a butyl group, etc.).

$Y_1$, $Y_2$, $Y_3$ and $Y_4$ each represents a polymethylene group having 2 to 12 carbon atoms (for example, an ethylene group, a butylene group, a hexylene group, a decamethylene group, a dodecamethylene group, etc.), a polymethylene group having 2 to 12 carbon atoms substituted with an alkyl group having 1 to 4 carbon atoms such as a methyl group, an ethyl group, a propyl group or a butyl group (for example, a 2-methylheptylene group, etc.), an arylene group (for example, a phenylene group, a biphenylene group, a triphenylene group, a naphthalene group, an anthracenylene group, etc.), an arylene group substituted with a sulfo group (or a salt thereof), a carboxyl group (or a salt thereof), an alkyl group having 1 to 4 carbon atoms or a halogen atom, or a cycloalkylene group (for example, a cyclopentylene group, a cyclohexylene group, etc.).

Typical examples of the compound having the repeating unit represented by general formula (I) are described below, but the compounds used in the present invention are not meant to be restricted to the examples.

I-1

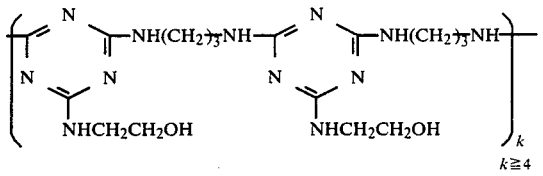

(wherein k represents the number of s-triazine rings contained in the molecule. k means the same hereinafter)

I-2

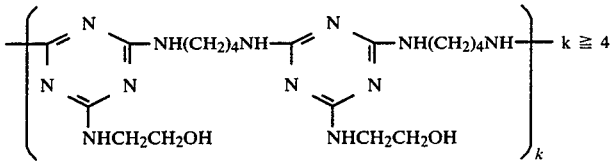

I-3

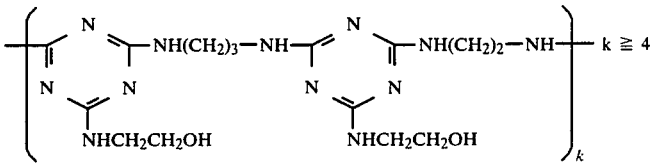

I-4

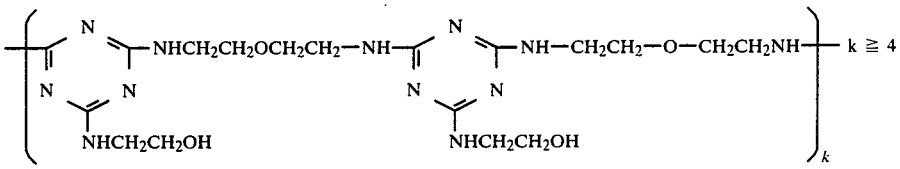

I-5

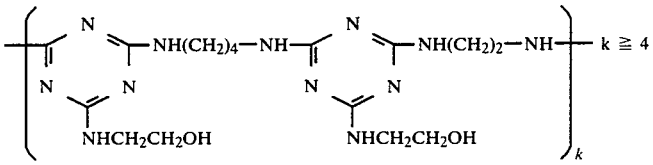

I-6

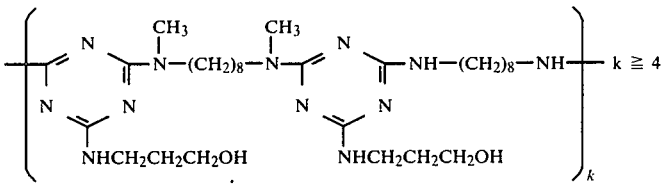

-continued
I-7
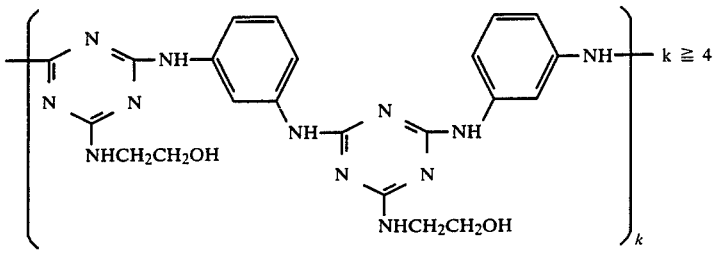
I-8
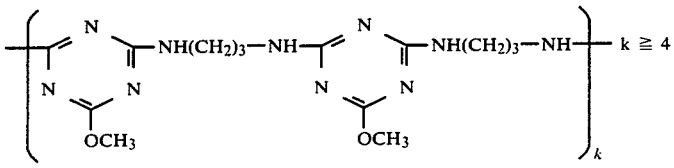
I-9
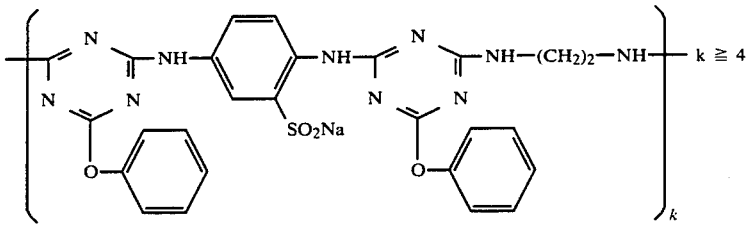
I-10
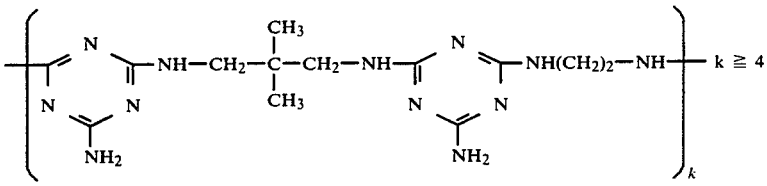
I-11
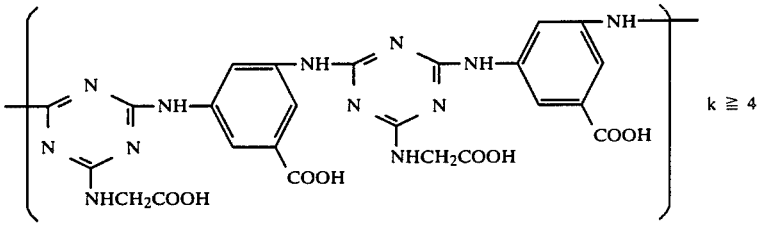
I-12
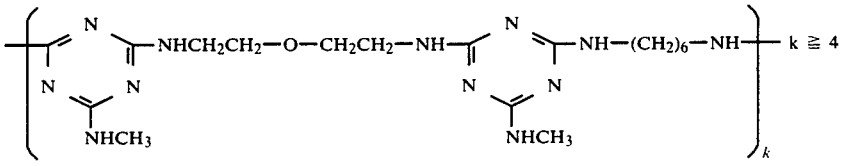
I-13
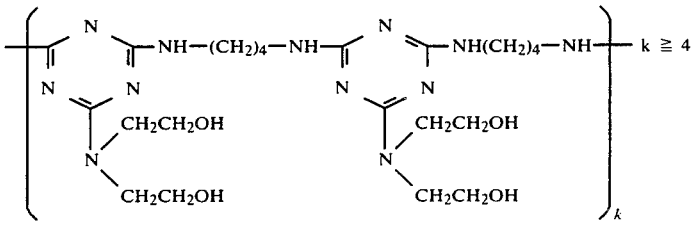

-continued
I-14
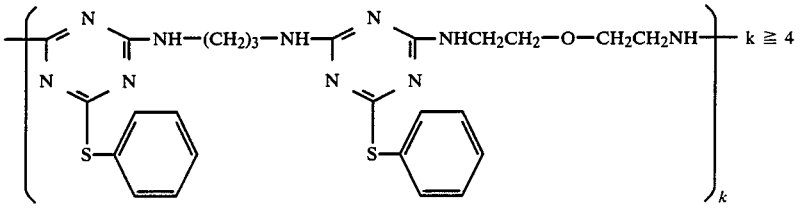
I-15
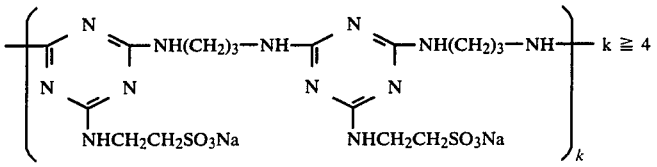
I-16
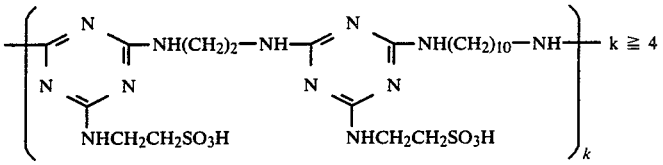
I-17
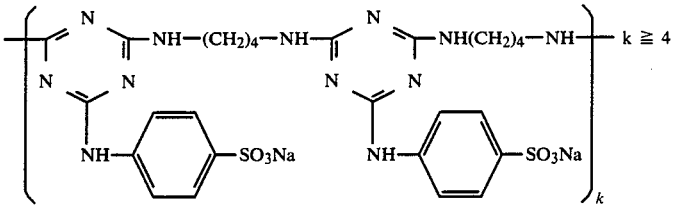
I-18
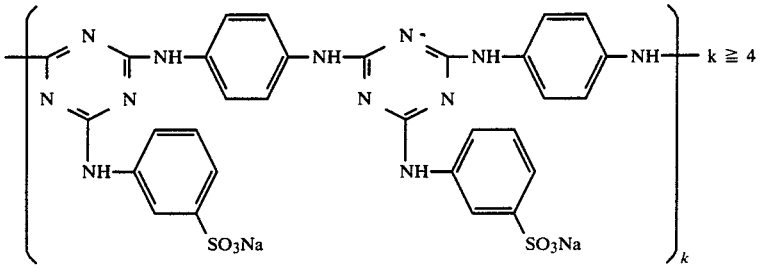
I-19
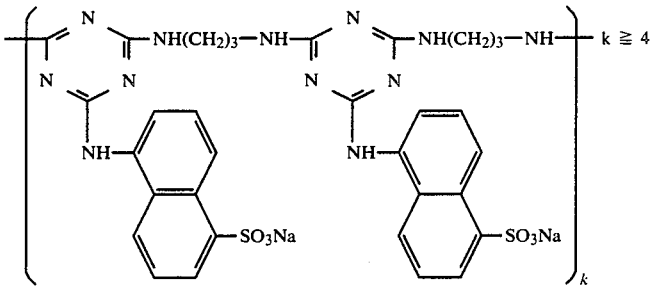
I-20
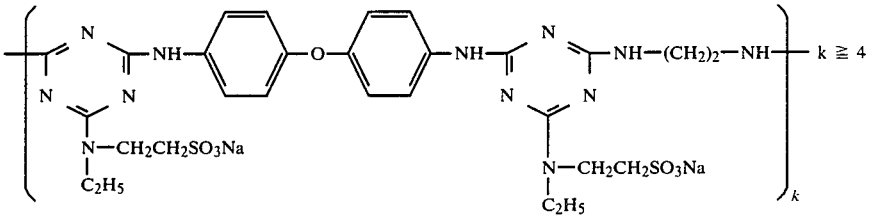

-continued
I-21
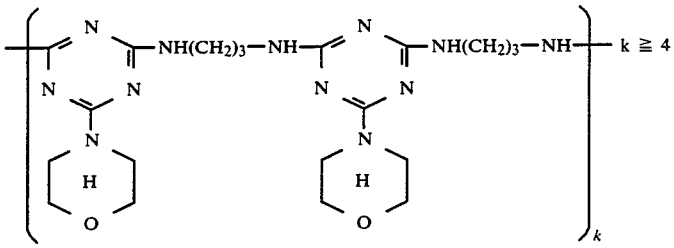
I-22
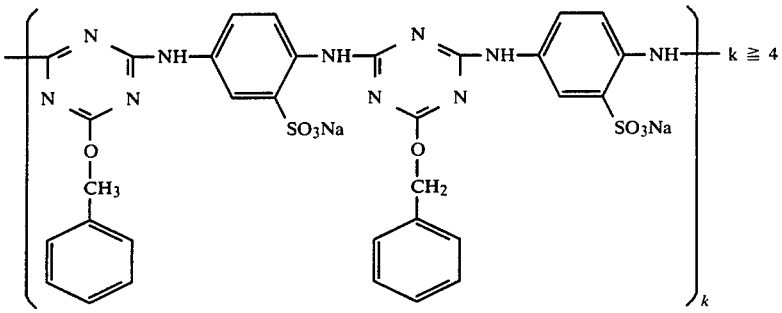
I-23
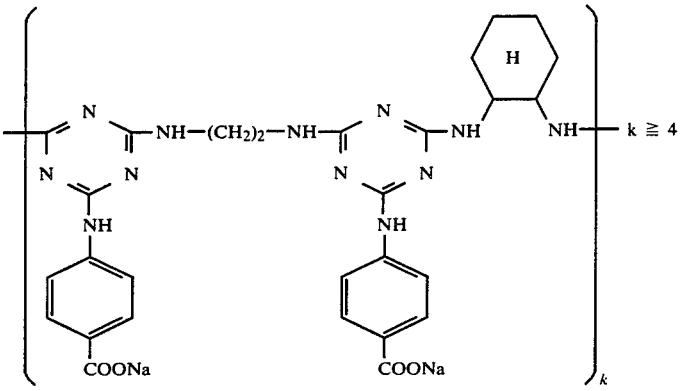
I-24
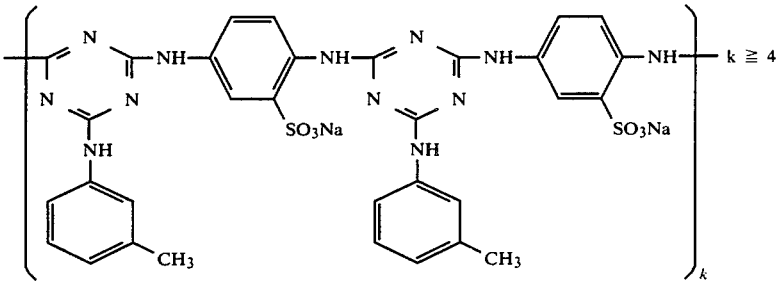
I-25
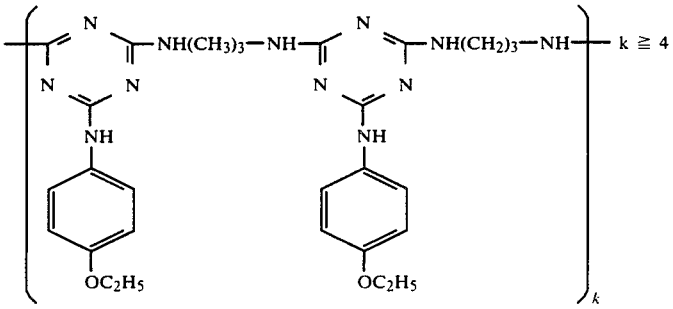

-continued
I-26
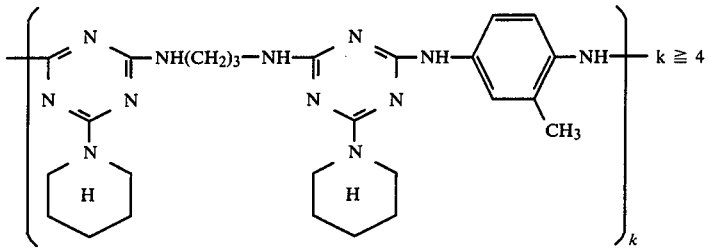
I-27
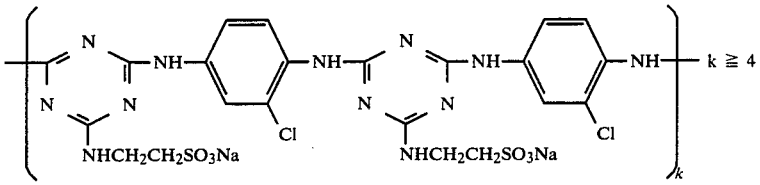
I-28
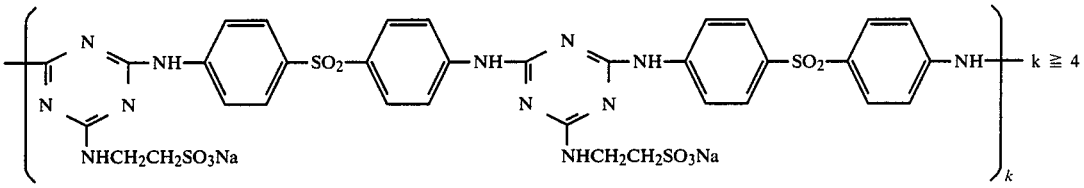
I-29
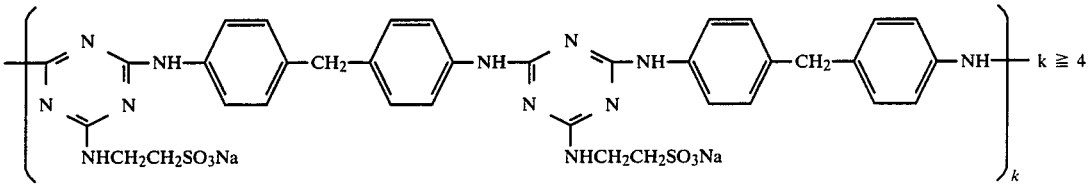
I-30
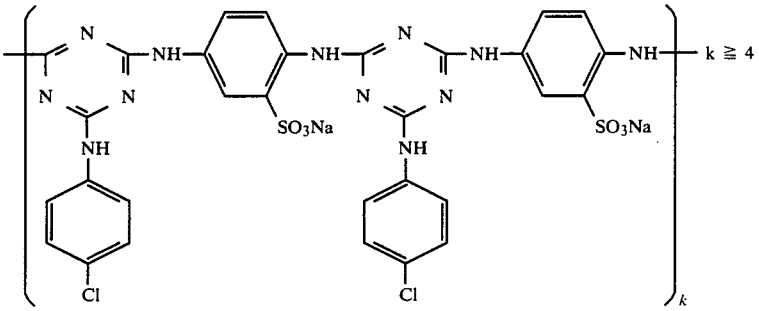
I-31
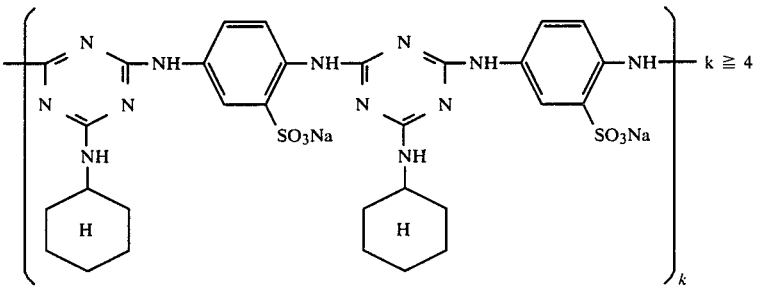

-continued

I-32

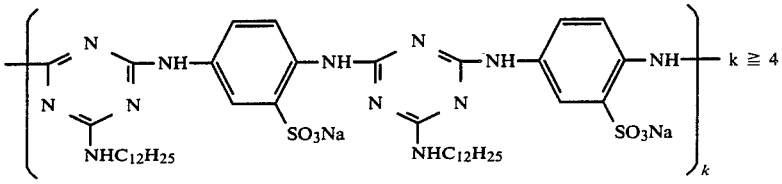

In the following, the compound represented by general formula (II) is described in detail.

In general formula (II), the alkyl group represented by $R_6$, $R_7$ and $R_8$ includes an unsubstituted alkyl group and a substituted alkyl group. The carbamoyl group represented by D and E includes an unsubstituted and a substituted carbamoyl group. The sulfamoyl group represented by D and E also includes an unsubstituted and a substituted sulfamoyl group.

In general formula (II) of sensitizing dyes used in the present invention, the following substituents are preferably used.

Namely, $R_6$ represents a hydrogen atom, an unsubstituted alkyl group having 6 or less carbon atoms (for example, a methyl group, an ethyl group, a propyl group, a butyl group, a pentyl group, a hexyl group, etc.) or a substituted alkyl group (examples of substituents include a halogen atom, an alkoxy group, a hydroxyl group, a carboxyl group, a phenyl group, etc.).

$R_7$ and $R_8$, which may be identical or different, each represents an unsubstituted alkyl group having 12 or less carbon atoms (for example, a methyl group, an ethyl group, a propyl group, a butyl group, a pentyl group, a hexyl group, an octyl group, etc.) or a substituted alkyl group (examples of substituents include a carboxyl group, a sulfo group, a hydroxyl group, a cyano group, a halogen atom (for example, a fluorine atom, a chlorine atom, a bromine atom, etc.), an alkoxy group having 8 or less carbon atoms (for example, a methoxy group, an ethoxy group, a benzyloxy group, a phenethyloxy group, etc.), an alkoxycarbonyl group having 8 or less carbon atoms (for example, a methoxycarbonyl group, an ethoxycarbonyl group, a phenethyloxycarbonyl group, a benzyloxycarbonyl group, etc.), an aryloxy group having 10 or less carbon atoms (for example, a phenoxy group, a p-tolyloxy group, etc.), an acyl group having 8 or less carbon atoms (for example, an acetyl group, a propionyl group, a benzoyl group, etc.), a substituted or unsubstituted carbamoyl group (for example, a carbamoyl group, an N,N-dimethylcarbamoyl group, a morpholinocarbamoyl group, a piperidinocarbamoyl group, etc.), a sulfamoyl group having 8 or less carbon atoms (for example, a sulfamoyl group, an N,N-dimethylsulfamoyl group, a morpholinosulfamoyl group, a piperidinosulfamoyl group, etc.), and an aryl group having 10 or less carbon atoms (for example, a phenyl group, a 4-methylphenyl group, a 4-fluorophenyl group, a 4-sulfophenyl group, 4-carboxyphenyl group, an α-naphthyl group, etc.)). However, at least one of $R_7$ and $R_8$ is an alkyl group substituted with a sulfo group or a carboxyl group.

D and E, which may be identical or different, each represents a hydrogen atom, a halogen atom (for example, a fluorine atom, a chlorine atom, a bromine atom), an alkyl group having 6 or less carbon atoms (for example, a methyl group, an ethyl group, a propyl group, a butyl group, etc.), a hydroxyl group, an alkoxycarbonyl group having 8 or less carbon atoms (for example, a methoxycarbonyl group, an ethoxycarbonyl group, a benzyloxycarbonyl group, etc.), an acyl group having 8 or less carbon atoms (for example, an acetyl group, a propionyl group, a benzoyl group, etc.), an acyloxy group having 8 or less carbon atoms (for example, an acetoxy group, a propionyloxy group, a benzoyloxy group, etc.), an alkoxy group having 8 or less carbon atoms (for example, a methoxy group, an ethoxy group, a propoxy group, a butoxy group or a benzoxy group, etc.), a carbamoyl group or a substituted carbamoyl group having 6 or less carbon atoms (for example, a carbamoyl group, an N,N-dimethylcarbamoyl group, a morpholinocarbamoyl group, etc.), a sulfamoyl group or a substituted sulfamoyl group having 6 or less carbon atoms (for example, a sulfamoyl group, an N,N-dimethylsulfamoyl group, a morpholinosulfamoyl group, etc.), a cyano group, a carboxyl group, a sulfo group, a trifluoromethyl group, a phenyl group or a benzene condensed ring. However, at least one of D and E represents a hydroxyl group, an alkoxy group, an alkoxycarbonyl group or a carboxyl group.

$Z_1$ represents an anion (for example, a halogen ion such as a chlorine, bromine, iodine ion, a perchlorate ion, a tetrafluoroborate ion, a p-toluenesulfonate ion, a p-chlorobenzenesulfonate ion, an ethylsulfonate ion or a thiocyanate ion).

Examples of dyes represented by general formula (II) of the present invention are described below. However, the present invention is not restricted to these examples.

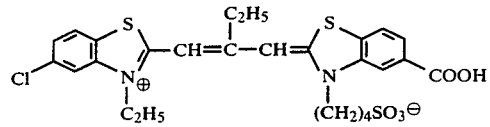

II-1

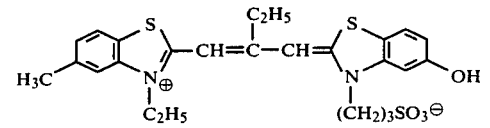

II-2

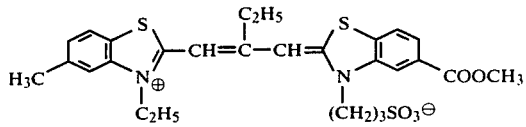

II-3

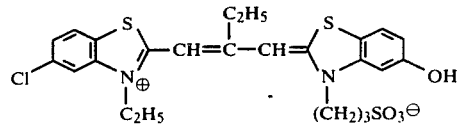

II-4

-continued

II-5

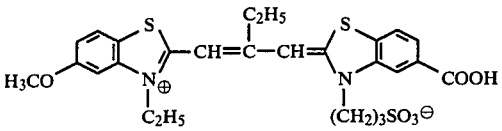

II-6

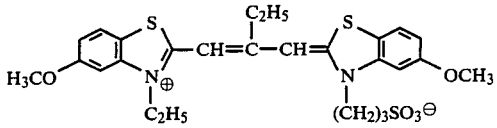

II-7

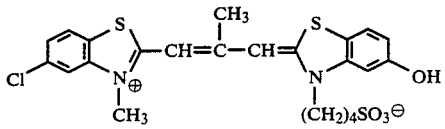

II-8

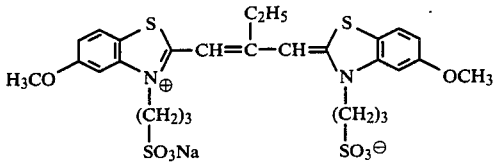

II-9

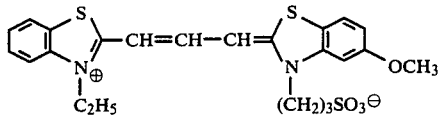

II-10

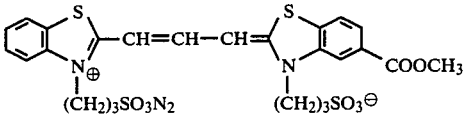

II-11

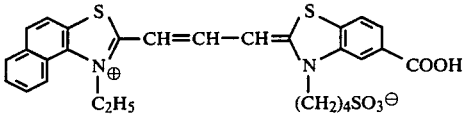

II-12

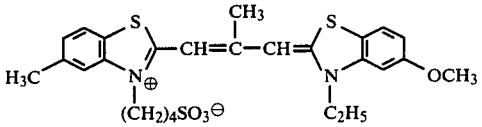

II-13

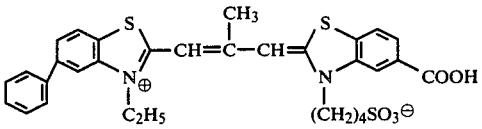

II-14

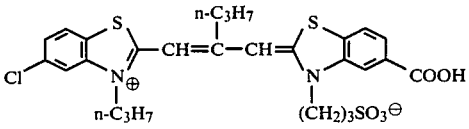

II-15

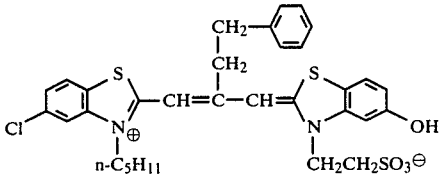

-continued

II-16

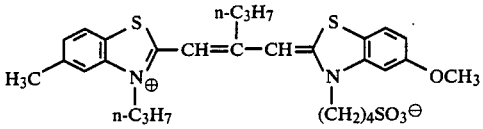

II-17

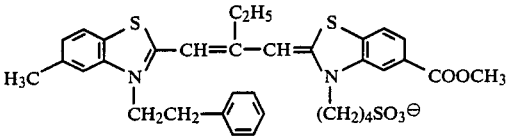

II-18

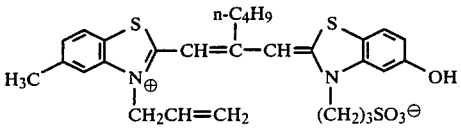

Compounds having the repeating unit represented by general formula (I) of the present invention are known and can be easily synthesized by the process described in Japanese Patent Publication No. 15471/71.

Compounds represented by general formula (II) of the present invention are also known and can be easily synthesized by processes known hitherto. Specifically, they have been described in U.S. Pat. No. 2,704,718, 2,704,714, etc.

The amount of the compound having the repeating unit represented by general formula (I) is not particularly restricted. When used in the silver halide emulsion layer, it is in the range of 0.01 to 50 g/mol of Ag. When used in the protective layer or the intermediate layer, there is no restriction, but it is suitable to be in the range of 0.05 to 250 g/kg of gelatin.

The amount of the compound represented by general formula (II) is not particularly restricted. When used in the silver halide emulsion layer, it is preferred to be in the range of $1\times10^{-5}$ to $2\times10^{-3}$ mol/mol of Ag.

The compound having the repeating unit represented by general formula (I) is particularly preferred to be used in the same emulsion layer as that sensitized with the compound represented by general formula (II), but it may be used in another layer. Alternatively, the compound having the repeating unit represented by formula (I) may be used in the development processing solution.

The compound having the repeating unit represented by general formula (I) and the compound represented by general formula (II) can be incorporated in photographic emulsions by conventional processes. Generally, they are added to the emulsion by dissolving in a solvent such as methanol, ethanol, water, methyl cellosolve or ketones soluble in water. Addition may be carried out in any stage of the process for producing the emulsion.

The sensitizing dye represented by general formula (II) may be used in combination with other sensitizing dyes such as cyanine dyes, merocyanine dyes, complex cyanine days, complex merocyanine dyes, holopolar cyanine dyes, hemicyanine dyes, styryl dyes, hemioxonol dyes, etc. The combinations of sensitizing dyes are often used for the purpose of, particularly, supersensitization. As sensitizing dyes used in combination with the sensitizing dye represented by general formula (II), dyes represented by the following general formula (III) are preferred.

(III)

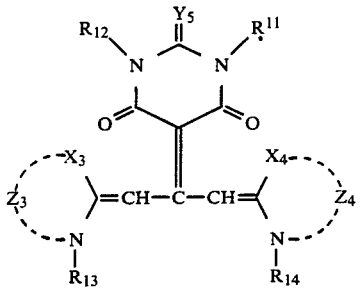

wherein $Y_5$ represents an oxygen atom or a sulfur atom; $X_3$ and $X_4$ each represents a sulfur atom or a selenium atom; $Z_3$ and $Z_4$ each represents a non-metal atomic group necessary to form a benzene ring or a naphthalene ring; $R_{11}$ and $R_{12}$ each represents an alkyl group having 6 or less carbon atoms, or an alkyl group having 6 or less carbon atoms which is substituted with an alkoxy group having 1 to 4 carbon atoms, a chlorine atom, a fluorine atom or a phenyl group; and $R_{13}$ and $R_{14}$ each represents an alkyl group having 10 or less carbon atoms or an alkyl group having 6 or less carbon atoms which is substituted with a sulfo group, a hydroxy group, a carboxyl group, a carbamoyl group, a sulfophenyl group, a carboxyphenyl group or a halogen atom.

In the following, preferred examples of the compounds represented by general formula (III) are represented by general formulae (III-A) and (III-B).

(III-A)

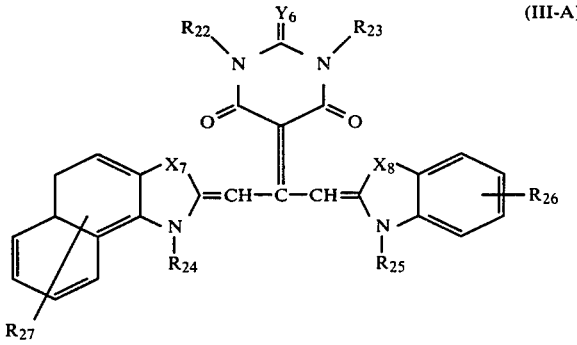

(III-B)

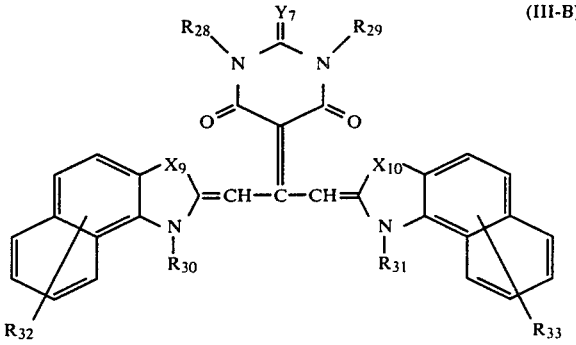

wherein $Y_6$ and $Y_7$ each represents an oxygen atom or a sulfur atom and, preferably, an oxygen atom.

$R_{22}$, $R_{23}$, $R_{28}$ and $R_{29}$ each represents a lower alkyl group having 1 to 6 carbon atoms which may be substituted with a lower alkoxy group having 1 to 4 carbon atoms, a chlorine atom, a fluorine atom, or a phenyl group. (Preferably, an alkyl group substituted with an alkoxy group.) $R_{24}$, $R_{25}$, $R_{30}$ and $R_{31}$ each represents a sulfoalkyl group having 2 to 4 carbon atoms, a carboxyalkyl group having 2 to 5 carbon atoms, a hydroxyalkyl group having 2 to 6 carbon atoms, an alkyl group having 2 to 5 carbon atoms which is substituted with an unsubstituted carbamoyl group, or a lower alkyl group having 6 or less carbon atoms which may be substituted with a fluorine atom, a chlorine atom, an alkoxy group having 1 to 4 carbon atoms, a phenyl group or a sulfophenyl group.

$R_{26}$, $R_{27}$, $R_{32}$ and $R_{33}$ each represents a hydrogen atom, a chlorine atom, a bromine atom, a lower alkyl group having 1 to 7 carbon atoms, a lower alkoxy group having 1 to 6 carbon atoms, a carboxyl group, a hydroxyl group, an alkoxycarbonyl group having a total of 2 to 5 carbon atoms, an acylamino group having 2 to 5 carbon atoms in the acyl moiety, or a phenyl group which may be substituted with a chlorine atom, a bromine atom, an alkyl group having 4 or less carbon atoms or an alkoxy group having 4 or less carbon atoms. $R_{22}$, $R_{23}$, $R_{28}$ and $R_{29}$ may be identical to or different from one another.

$R_{26}$, $R_{27}$, $R_{32}$ and $R_{33}$ may be identical to or different from one another.

$R_{24}$, $R_{25}$, $R_{30}$ and $R_{31}$ are particularly preferred to be selected from a methyl group, an ethyl group or a sulfopropyl group.

$X_7$, $X_8$, $X_9$ and $X_{10}$ each represents a sulfur atom or a selenium atom and they may be identical to or different from one another.

In the following, examples of the dyes represented by general formula (III) are described, but the dyes are not restricted to the specific examples.

III-1

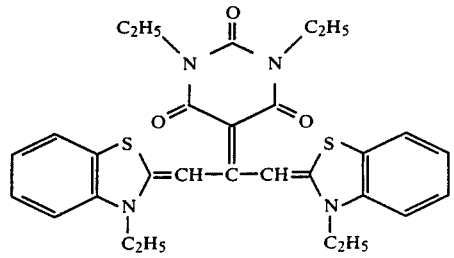

III-2

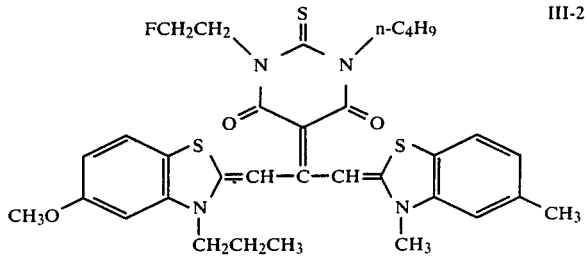

III-3

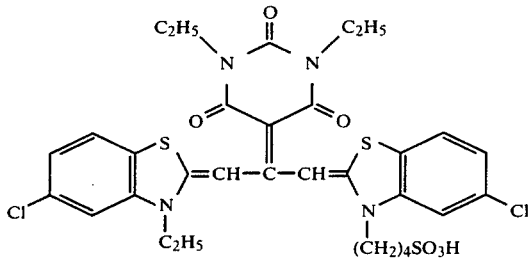

-continued
III-4
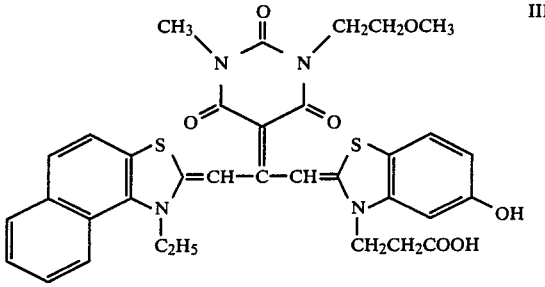
III-5
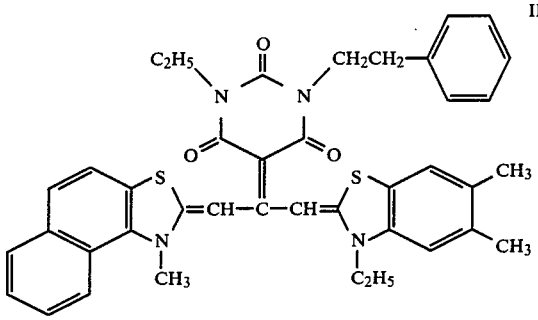
III-6
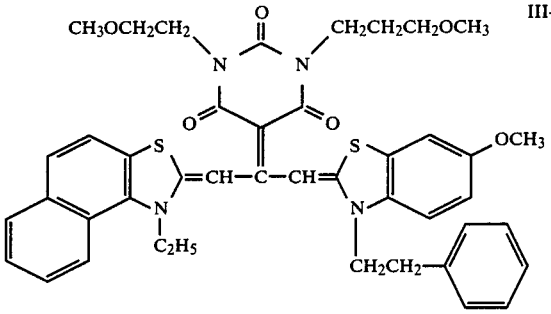
III-7
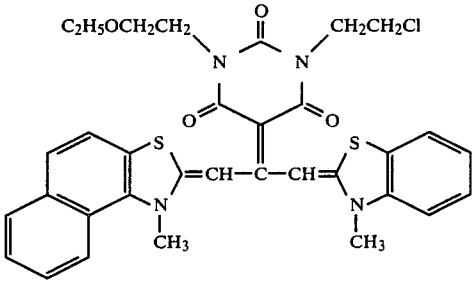
III-8
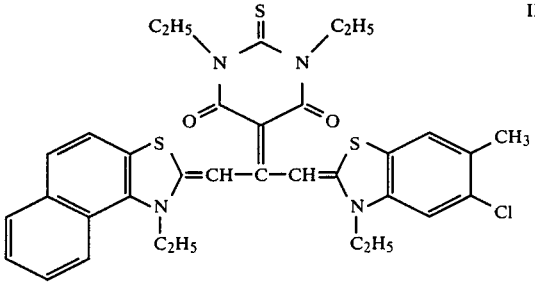
-continued
III-9
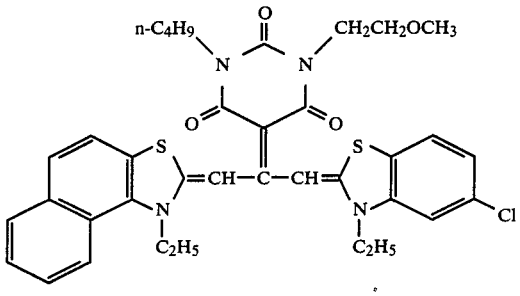
III-10
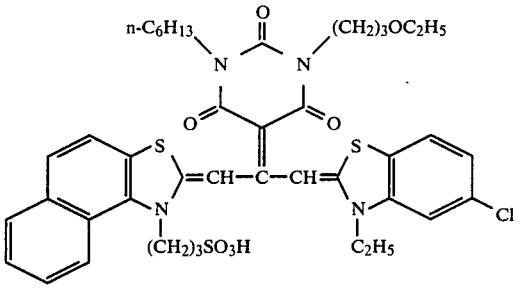
III-11
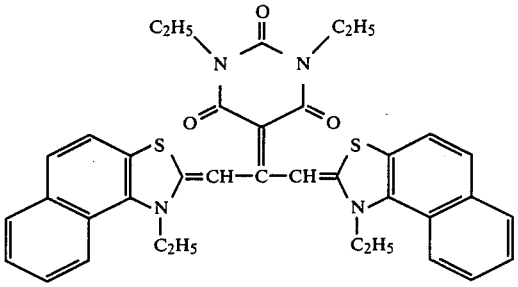
III-12
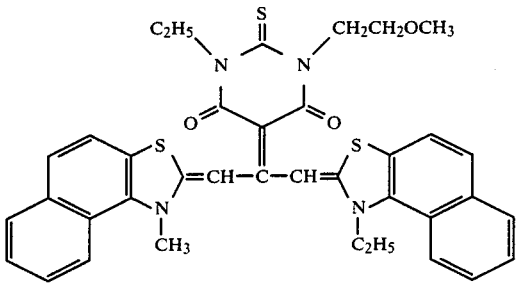
III-13
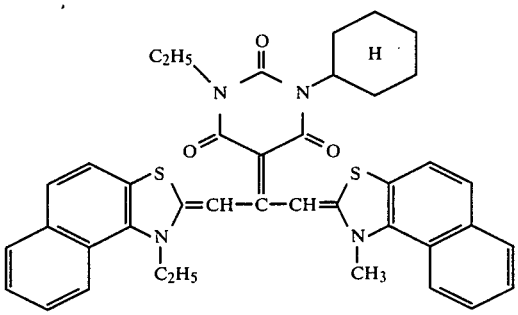

-continued
III-14
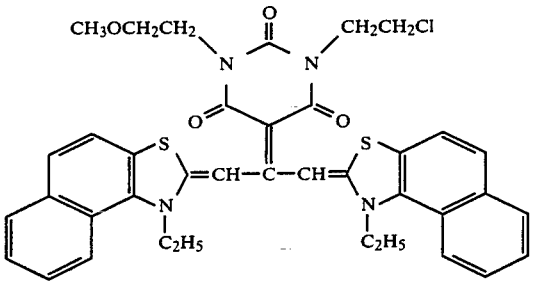
III-15
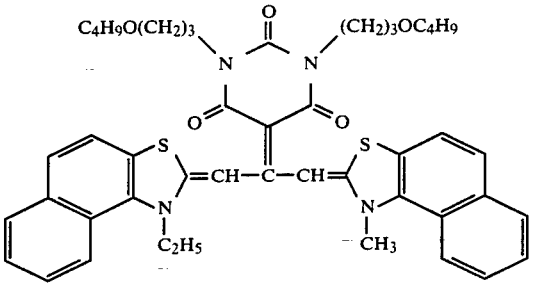
III-16
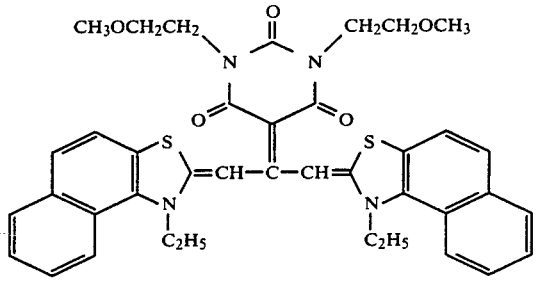
III-17
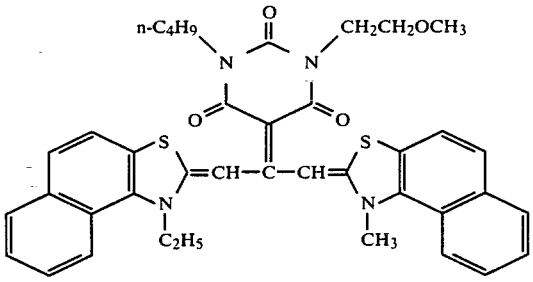
III-18
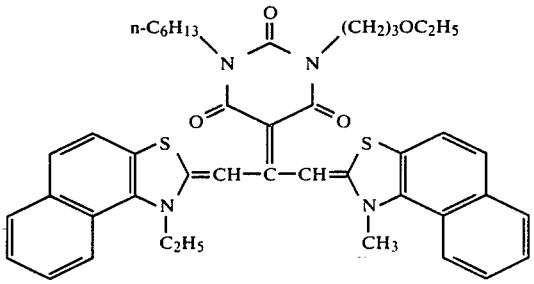
-continued
III-19
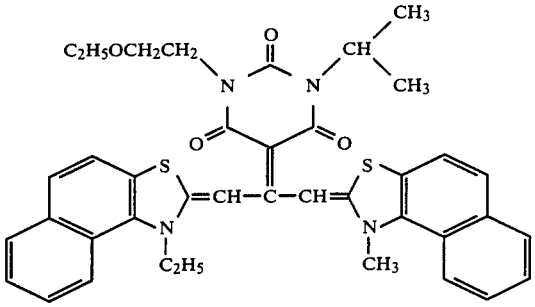
III-20
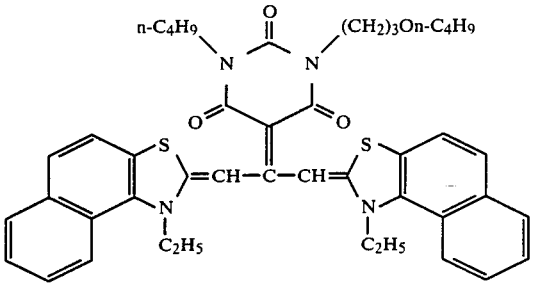
III-21
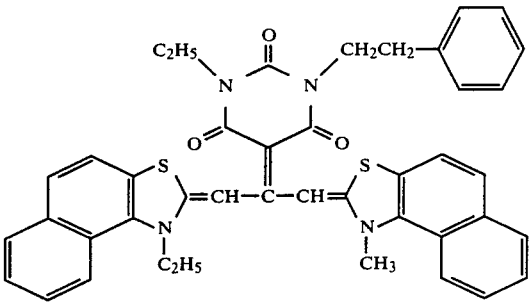
III-22
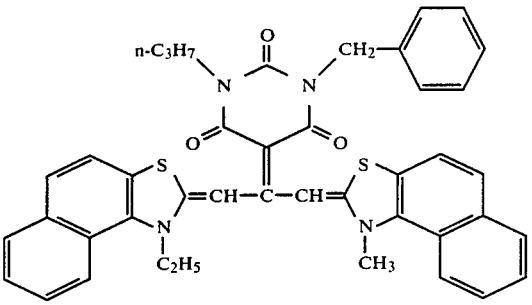
III-23
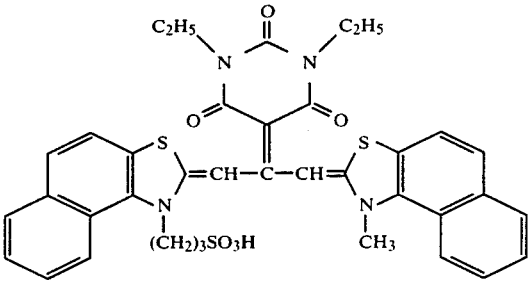

-continued

III-24

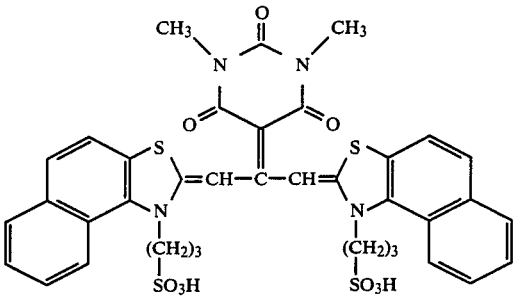

III-25

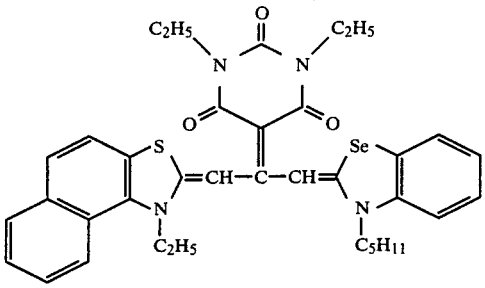

III-26

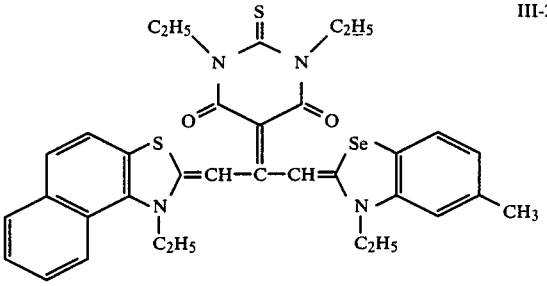

III-27

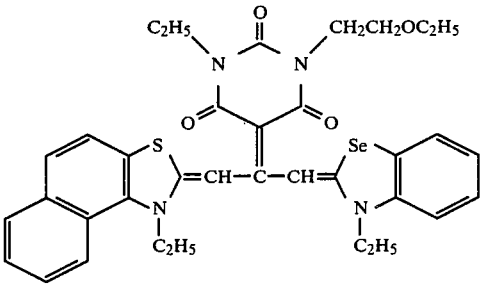

III-28

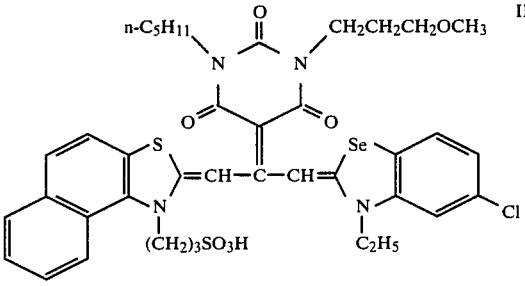

-continued

III-29

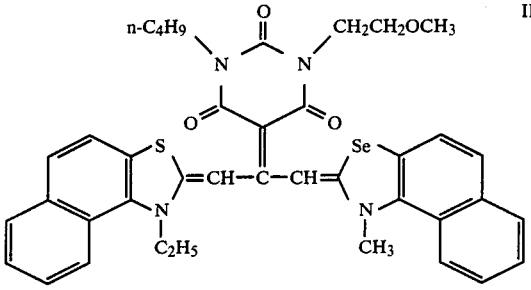

The sensitizing dyes represented by general formula (III) are preferred to be used in an amount of 1/5 to 1/200 and, preferably, 1/10 to 1/100 of the compound represented by general formula (II) in a mol ratio.

In the present invention, if the amount of iodine ion added to the surface of silver halide grains by adsorption or halogen conversion is large, intrinsic desensitization of silver halide grains becomes great, and sometimes there arises a problem that the sensitivity is reduced even after color sensitization or a problem that the development rate of the silver halide grains becomes low. If the amount of iodine ion added is too small, adsorption of sensitizing dyes is not sufficiently accelerated and the sensitivity is reduced. Accordingly, the amount of iodine added is preferred to be selected from a range which minimizes the above described problems. Accordingly, the amount of iodine ion added by adsorption or halogen conversion is preferred to be in the range of $10^{-7}$ to $10^{-2}$ mol and, preferably $10^{-6}$ to $10^{-3}$ mol per mol of silver halide. The iodine ion is added as an aqueous solution of sodium iodide, potassium iodide or ammonium iodide, etc.

In the present invention, the order of addition of the compound having the repeating unit represented by general formula (I), the compound represented by general formula (II) and the iodine ion is not particularly restricted.

In the photographic emulsion layers of the photographic light-sensitive materials of the present invention, any of silver bromide, silver iodobromide, silver iodochlorobromide, silver chlorobromide and silver chloride may be used as the silver halide. However, surface low iodine type silver iodobromide is preferred.

Silver halide grains in the photographic emulsions may have a regular crystal form such as a cube or an octahedron, or may have an irregular crystal form such as a sphere or a plate, etc., or a mixed crystal form. They may be composed of a mixture of grains having different crystal forms.

Silver halide grains may be those in which a latent image is formed chiefly on the surface or may be those in which a latent image is formed chiefly in the inner part thereof.

The photographic emulsions used in the present invention can be prepared by processes described in P. Glafkides, *Chimie et Physique Photographique* (Paul Montel, 1967), G. F. Duffin, *Photographic Emulsion Chemistry* (The Focal Press, 1966), and V. L. Zelikman et al., *Making and Coating Photographic Emulsion* (The Focal Press, 1964), etc. Namely, any of an acid process, a neutral process and an ammonia process may be used. As a manner of reacting soluble silver salts with soluble halogen salts, any of a single jet mixing process, a double jet mixing process and a combination of these processes may be used.

A process of forming grains in the presence of excess silver ion (the so-called back mixing process) can be used.

As a type of the double jet mixing process, a process wherein pAg in a liquid phase in which silver halide is formed is kept constant, namely, the so-called controlled double jet process, can be used.

According to this process, silver halide emulsions having a regular crystal form and a nearly uniform particle size can be obtained.

Two or more silver halide emulsions prepared respectively may be used as a mixture.

During the step of formation of silver halide grains or physical ripening, cadmium salts, zinc salts, lead salts, thallium salts, iridium salts or complex salts thereof, rhodium salts or complex salts thereof, iron salts or complex salts thereof, etc., may be allowed to coexist.

In the photographic emulsions used in the present invention, various compounds may be incorporated for the purpose of preventing fog in the process of producing the light-sensitive materials, during preservation or during photographic processing or of stabilizing photographic performances. Namely, it is possible to add various compounds known as antifoggants or stabilizers, such as azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; azaindenes, for example, triazaindenes, tetraazaindenes (particularly, 4-hydroxy substituted (1,3,3a,7)tetraazaindenes), pentaazaindenes, etc.; benzenethiosulfonic acid, benzenesulfinic acid, benzenesulfonic acid amide, etc. For example, it is possible to use those described in U.S. Pat. Nos. 3,954,474 and 3,982,947 and Japanese Patent Publication No. 28660/77.

In order to remove soluble salts from the emulsions after formation of precipitates or after physical ripening, a noodle water washing process in which gelatin is gelatinized may be used, or a precipitation process (flocculation) utilizing inorganic silver salts, anionic surface active agents, anionic polymers (for example, polystyrenesulfonic acid) or gelatin derivatives (for example, acylated gelatin, carbamoylated gelatin, etc.) may be used.

Silver halide emulsions are generally chemically sensitized. Chemical sensitization can be carried out according to processes described in, for example, H. Frieser, *Die Grundlagen der Photographischen Prozesse mit Silberhalogeniden* (Akademische Verlagsgesellschaft, 1968), pages 675–734.

Namely, a sulfur sensitization process using sulfur containing compounds capable of reacting with active gelatin or silver (for example, thiosulfates, thioureas, mercapto compounds and rhodanines), a reduction sensitization process using reducing substances (for example, stannous salts, amines, hydrazine derivatives, formamidine-sulfinic acid and silane compounds), and a noble metal sensitization process using noble metal compounds (for example, complex salts of group VIII metals such as Pt, Ir, Pd, etc., as well as gold complex salts), etc., can be used alone or in combination.

Examples of the sulfur sensitization process have been described in U.S. Pat. Nos. 1,574,944, 2,410,689, 2,278,947, 2,728,668 and 3,656,955, those of the reduction sensitization process have been described in U.S. Pat. Nos. 2,983,609, 2,419,974 and 4,054,458, and those of the noble metal sensitization process have been described in U.S. Pat. Nos. 2,399,083 and 2,448,060 and British Pat. No. 618,061.

For the purpose of enhancing sensitivity, increasing contrast or accelerating development, the photographic emulsion layers of the photographic light-sensitive materials of the present invention may contain, for example, polyalkylene oxides or derivatives thereof such as ethers, esters, amines, etc., thioether compounds, thiomorpholines, quaternary ammonium salt compounds, urethane derivatives, urea derivatives, imidazole derivatives, 3-pyrazolidones, etc. For example, it is possible to use those described in U.S. Pat. Nos. 2,400,532, 2,423,549, 2,716,062, 3,617,280, 3,772,021 and 3,808,003, and British Pat. No. 1,488,991, etc.

As a binder or a protective colloid for the photographic emulsions, though gelatin is advantageously used, other hydrophilic colloids can be used.

For example, it is possible to use proteins such as gelatin derivatives, graft polymers of gelatin and other high polymers, albumin, casein, etc.; cellulose derivatives such as hydroxyethyl cellulose, carboxymethyl cellulose, cellulose sulfate, etc.; sugar derivatives such as sodium alginate, starch derivatives, etc.; and various synthetic hydrophilic high polymer substances such as homopolymers or copolymers of polyvinyl alcohol, polyvinyl alcohol partial acetate, poly-N-vinylpyrrolidone, polyacrylic acid, polymethacrylic acid, polyacrylamide, polyvinyl imidazole, polyvinyl pyrazole, etc.

The photographic emulsion layers of the photographic light-sensitive materials of the present invention may contain dye forming couplers, namely, compounds capable of coloring by oxidation coupling with aromatic primary amine developing agent (for example, phenylenediamine derivatives, aminophenol derivatives, etc.) in the color development processing. There are, for example, 5-pyrazolone couplers, pyrazolobenzimidazole couplers, cyanoacetyl coumarone couplers, open chain acylacetonitrile couplers, etc. as magenta couplers, acylacetamide couplers (for example, benzoylacetanilides and pivaloylacetanilides), etc. as yellow couplers, and naphthol couplers and phenol couplers as cyan couplers. In these couplers, nondiffusible couplers having a hydrophobic group called a ballast group in the molecule are suitable. The couplers may be either 4-equivalent type or 2-equivalent type to silver ions. Colored couplers having an effect of color correction and couplers which release a development inhibitor by development (the so-called DIR coupler) may be used.

Noncoloring DIR coupling compounds which form a colorless product by a coupling reaction and release a development inhibitor may be included other than DIR couplers.

In order to introduce the couplers into silver halide emulsion layers, known processes, for example, a process described in U.S. Pat. No. 2,322,027 can be used. For example, they are dispersed in a hydrophilic colloid after they are dissolved in phthalic acid alkyl esters (dibutyl phthalate, dioctyl phthalate, etc.), phosphoric acid esters (diphenyl phosphate, triphenyl phosphate, tricresyl phosphate and dioctylbutyl phosphate), citric acid esters (for example, tributyl acetylcitrate), benzoic acid esters (for example, octyl benzoate), alkylamides (for example, diethyllaurylamide), aliphatic acid esters (for example, dibutoxyethyl succinate and dioctyl azelate) and trimesic acid esters (for example, tributyl trimesate), etc., or organic solvents having a boiling point of about 30° C. to 150° C., for example, lower alkyl acetate such as ethyl acetate or butyl acetate, ethyl propionate, secondary butyl alcohol, methyl isobutyl ketone, β-ethoxyethyl acetate, methyl cellosolve acetate, etc. The above described high boiling point organic solvents may be used as a mixture with the low boiling point organic solvents.

The color light-sensitive materials of the present invention may contain various other known additives, for example, dyes, hardeners, surface active agents, fading preventing agents, development accelerators, UV absorbing agents, matting agents and fluorescent whitening agents.

Examples of these materials have been described in, for example, *Research Disclosure,* No. 176 (RD-17643).

In the photographic light-sensitive materials of the present invention, the photographic emulsion layers and other layers are formed by applying the emulsion layers to flexible bases conventionally used for photographic light-sensitive materials, such as plastic films, papers, cloths, etc. Examples of useful flexible bases include films composed of semisynthetic or synthetic high polymers such as cellulose nitrate, cellulose acetate, cellulose acetate butyrate, polystyrene, polyvinyl chloride, polyethylene terephthalate or polycarbonate, etc., and papers coated or laminated with a baryta layer or α-olefin polymer (for example, polyethylene, polypropylene or ethylene/butene copolymer), etc. The bases may be colored with dyes or pigments. They may be blacked for the purpose of shielding light. The surface of these bases is generally subjected to undercoating processing for the purpose of improving adhesion to the photographic emulsion layer, etc. The surface of the bases may be subjected to corona discharging, ultraviolet ray application or flame treatment, etc., before or after the undercoating processing.

As silver halide color light-sensitive materials of the present invention, there are, for example, color films for photographing such as color negative films or color reversal films, etc., as well as light-sensitive materials for printing such as color papers, etc.

Photographic processing of the light-sensitive materials of the present invention can be carried out according to any of the known processes with any of the known processing solutions, as described in, for example, *Research Disclosure,* No. 176, pp. 28–30 (RD-17643). The processing temperature is selected generally between 18° C. to 50° C., but a temperature lower than 18° C. or a temperature higher than 50° C. may be used.

In the case of forming dye images, conventional processes can be used. For example, a negative-positive process (described in, for example, *Journal of the Society of Motion Picture and Television Engineers,* Vol. 61 (1953), pp. 667–701); a color reversal process which comprises forming a negative silver image by developing with a developing solution containing a black-and-white developing agent, carrying out at least one uniform exposure or another suitable fogging processing, and subsequently carrying out color development to form a dye positive image; and a silver dye bleach process which comprises forming a silver image by developing photographic emulsion layers containing dyes after exposing to light, and bleaching the dyes with the silver image as a bleaching catalyst are used.

The color developing solution is generally an alkaline aqueous solution containing a color developing agent. As the color developing agents, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

In addition, those described in L. F. A. Mason, *Photographic Processing Chemistry* (Focal Press, 1966), pp. 226–229, U.S. Pat. Nos. 2,193,015 and 2,592,364, Japanese Patent Application (OPI) No. 64933/73 (the term "OPI" as used herein refers to a "published unexamined Japanese patent application"), etc., may be used.

The color developing solution may further contain pH buffers, development restrainers, antifoggants, etc. If necessary, it may contain water softeners, preservatives, organic solvents, development accelerators, dye forming couplers, competing couplers, foggants, auxiliary developing agents, thickening agents, polycarboxylic acid type chelating agents, antioxidants, etc.

Examples of these additives are described in *Research Disclosure* (RD-17643), U.S. Pat. No. 4,083,723, West German Patent Application (OLS) No. 2,622,950, etc.

The photographic emulsion layers after color development are generally subjected to bleach processing. The bleach processing may be carried out simultaneously with the fixation processing or may be carried out alone. As bleaching agents, compounds of polyvalent metals such as iron (III), cobalt (III), chromium (VI), copper (II), etc., peracids, quinones, nitroso compounds, etc., are used.

Various additives including bleaching accelerators described in U.S. Pat. Nos. 3,042,520 and 3,241,966, Japanese Patent Publication Nos. 8506/70, 8836/70, etc., and thiol compounds described in Japanese Patent Application (OPI) No. 65732/78 can be added to the bleaching solution or bleach-fix solution.

In the following the present invention is illustrated in detail with reference to examples. However, the examples are not meant to be limiting.

Unless otherwise specified, all percents, ratios, etc., are by weight.

EXAMPLE 1

To a triacetate film base, the first layer to the twelfth layer were applied in the following order to produce a color reversal photographic light-sensitive material.

First Layer: Antihalation layer (gelatin layer containing black colloidal silver)

Second Layer: Gelatin intermediate layer 2 kg of an emulsion obtained by dissolving 2,5-di-t-octylhydroquinone in a mixture of 100 cc of dibutyl phthalate and 100 cc of ethyl acetate and mixed with 1 kg of a 10% aqueous solution of gelatin by stirring at a high rate was mixed with 1 kg of a fine grain containing emulsion which was not chemically sensitized (particle size: 0.06 μm, 1 mol% silver iodobromide emulsion) together with 1.5 kg of 10% gelatin. The resulting solution was applied so as to result in a dry film thickness of 2 μm (silver amount: 0.4 g/m$^2$).

Third Layer: Low speed red-sensitive emulsion layer

A surface low iodine type silver iodobromide emulsion containing 4.0% by mol of iodine ion was prepared by a double jet process as follows.

In a reactor kept at 60° C., water (1,000 cc), inactive gelatin (25 g), potassium iodide (4 g) and potassium bromide (10 g) were allowed to exist, and the mixture was continuously stirred.

To this reactor, a solution containing 100 g of silver nitrate dissolved in 300 cc of water and a solution containing 85 g of potassium bromide dissolved in 250 g of water were continuously added over 36 minutes. Subsequently, the emulsion was solidified by cooling and washed with water by a noodle method to remove soluble substances.

Then, the pAg was adjusted to 9.0 with a 1 mol solution of potassium bromide. The temperature of the reactor was kept at 60° C., and a 0.01 mol solution of sodium dithiosulfite aurate (I) was added in an amount of 9 ml/kg emulsion to carry out ripening for 30 minutes.

To the resulting silver iodobromide emulsion having an average particle size of 0.6 μm, potassium iodide was added in an amount of $5.20\times10^{-4}$ mol/mol Ag, and further a sensitizing dye represented by II-1 was added in an amount of $5\times10^{-4}$ mol/mol Ag and a compound represented by III-17 was added as a supersensitizing agent in an amount of $2\times10^{-5}$ mol/mol Ag to adsorb them in grains. To 1 kg of the resulting red-sensitive silver iodobromide emulsion, 500 g of an emulsion obtained by dissolving 100 g of a cyan coupler: 2-(heptafluorobutyramido)-5-[2'-(2'',4''-di-t-aminophenoxy)-butyramido]phenol in a mixture of 100 cc of tricresyl phosphate and 100 cc of ethyl acetate and stirring at a high rate together with 1 kg of a 10% aqueous solution of gelatin was added and the mixture was applied so as to result in a dry film thickness of 1μ (silver amount: 0.5 g/m$^2$).

Fourth Layer: High speed red-sensitive emulsion layer

To an emulsion prepared by forming silver iodobromide grains having an iodine content of 6.0% by mol and a particle size of 1.0 μm by a silver halide grain forming process analogous to that for the emulsion of the third layer and carrying out desalting and chemical sensitization by the same manner as in the emulsion of the third layer, potassium iodide was added in an amount of $2.10\times10^{-4}$ mol/mol Ag, and further a sensitizing dye representing by II-1 was added in an amount of $2\times10^{-4}$ mol/mol Ag and a compound represented by III-17 was added as a supersensitizing agent in an amount of $8\times10^{-6}$ mol/mol Ag to adsorb them in the grains. To 1 kg of the resulting red-sensitive silver iodobromide emulsion, 1,000 g of an emulsion prepared by dissolving 100 g of a cyan coupler: 2-(heptafluorobutyramide)-5-[2'-(2'',4''-di-t-aminophenoxy)-butyramido]phenol in a mixture of 100 cc of tricresyl phosphate and 100 cc of ethyl acetate and stirring at a high rate together with 1 kg of a 10% aqueous solution of gelatin was added and the mixture was applied so as to result in a dry film thickness of 2.5μ (silver amount: 0.8 g/m$^2$).

Fifth Layer: Intermediate layer 1 kg of an emulsion obtained by stirring at a high rate a solution of 2,5-di-t-octylhydroquinone in a mixture of 100 cc of dibutyl phthalate and 100 cc of ethyl acetate together with 1 kg of a 10% aqueous solution of gelatin was mixed with 1 kg of a 10% aqueous solution of gelatin and the mixture was applied so as to result in a dry film thickness of 1 μm.

Sixth Layer: Low speed green-sensitive emulsion layer 300 g of an emulsion obtained by the same manner as in the emulsion of the third layer, except that a magenta coupler: 1-(2,4,6-trichlorophenyl)-3-[3-(2,4-di-t-amylphenoxyacetamide)benzamide]-5-pyrazolone was used instead of the cyan coupler, was mixed with 1 kg of a green-sensitive silver bromoiodide emulsion (containing 70 g of silver and 60 g of gelatin, iodine content: 7% by mol) and the mixture was applied so as to result in a dry film thickness of 1.3 μm (silver amount: 1.1 g/m$^2$).

Seventh Layer: High speed green-sensitive emulsion layer 1 kg of an emulsion obtained by the same manner as in the emulsion of the third layer, except that a magenta coupler: 1-(2,4,6-trichlorophenyl)-3-[3-(2,4-di-t-amylphenoxyacetamido)benzamide]-5-pyrazolone was used instead of the cyan coupler, was mixed with 1 kg of a green-sensitive silver iodobromide emulsion (containing 70 g of silver and 60 g of gelatin, iodine content: 6% by mol) and the mixture was applied so as to result in a dry film thickness of 3.5 μm (silver amount: 1.1 g/m$^2$).

Eighth Layer: Yellow filter layer

An emulsion containing yellow colloidal silver was applied so as to result in a dry film thickness of 1 μm.

Ninth Layer: Low speed blue-sensitive emulsion layer 1 kg of an emulsion obtained by the same manner as in the emulsion of the third layer, except that a yellow coupler: α-pivaloyl-α-(1-benzyl-5-ethoxy-3-hydantoinyl)-2-chloro-5-dodecyloxycarbonylacetanilide was used instead of the cyan coupler, was mixed with 1 kg of a blue-sensitive silver iodobromide emulsion (containing 70 g of silver and 60 g of gelatin, iodine content: 7% by mol), and the mixture was applied so as to result in a dry film thickness of 1.5 μm (silver amount: 0.4 g/m$^2$).

Tenth Layer: High speed blue-sensitive emulsion layer 1 kg of an emulsion obtained by the same manner as in the emulsion of the third layer, except that a yellow coupler: α-pivaloyl-α-(1-benzyl-5-ethoxy-3-hydantoinyl)-2-chloro-5-dodecyloxycarbonylacetanilide was used instead of the cyan coupler, was mixed with 1 kg of a blue-sensitive silver iodobromide emulsion (containing 70 g of silver and 60 g of gelatin, iodine content: 6% by mol), and the mixture was applied so as to result in a dry film thickness of 3 μm (silver amount: 0.8 g/m$^2$).

Eleventh Layer: Second protective layer

10% gelatin was applied so as to result in a dry film thickness of 2 μm.

Twelfth Layer: First protective layer

A 10% aqueous solution of gelatin containing a surface fogged fine grain-containing emulsion (particle size: 0.06 μm, 1 mol% silver iodobromide emulsion) was applied so as to result in a coated silver amount of 0.1 g/m$^2$ and a dry film thickness of 0.8 μm.

The sample produced as described above was referred to as Sample 1.

Samples 11 to 16 were prepared by adding various compounds having the repeating unit represented by general formula (I) to the third low speed red-sensitive emulsion layer as shown in Table 1. As comparative control samples, Samples 21 to 26 were prepared by adding Compounds IV-1 and IV-2 which did not have the repeating unit represented by general formula (I) and have an influence upon developing properties.

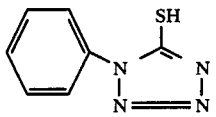

Compound IV-1

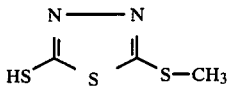

Compound IV-2

The resulting samples were exposed through a wedge for sensitometry using white light emitted from a 4,800° K. light source with an illuminance at exposed surface of 1,000 luxes, and thereafter subjected to the following standard reversal processing or reversal sensitization processing to obtain color images.

Processing steps and processing solutions used here were as follows.

| Step | Time | Temperature |
|---|---|---|
| Standard Processing Steps | | |
| First Development | 6 minutes | 38° C. |
| Water Washing | 2 minutes | " |
| Reversal | 2 minutes | " |
| Color Development | 6 minutes | " |
| Conditioning | 2 minutes | " |
| Bleaching | 6 minutes | " |
| Fix | 4 minutes | " |
| Water Washing | 4 minutes | " |
| Stabilization | 1 minute | Room Temperature |
| Drying | | |
| Sensitization Processing Steps | | |
| First Development | 10 minutes | 38° C. |
| Water Washing | 2 minutes | " |
| Reversal | 2 minutes | " |
| Color Development | 6 minutes | " |
| Conditioning | 2 minutes | " |
| Bleaching | 6 minutes | " |
| Fix | 4 minutes | " |
| Water Washing | 4 minutes | " |
| Stabilization | 1 minute | Room Temperature |
| Drying | | |

Compositions of the processing solutions used were as follows.

| | |
|---|---|
| First Developing Solution: | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| i-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |
| Reversal Solution: | |
| Water | 700 ml |
| Nitro-N,N,N—trimethylenephosphonic Acid 6 Na Salt | 3 g |
| Stannous Chloride (2 hydrate) | 1 g |
| p-Aminophenol | 0.1 g |
| Sodium Hydroxide | 8 g |
| Glacial Acetic Acid | 15 ml |
| Water to make | 1,000 ml |
| Color Developing Solution: | |
| Water | 700 ml |
| Sodium Tetrapolyphosphate | 2 g |
| Sodium Sulfite | 7 g |

-continued

| | |
|---|---|
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| Conditioning Solution: | |
| Water | 700 ml |
| Sodium Sulfite | 12 g |
| Sodium Ethylenediaminetetraacetate (2 hydrate) | 8 g |
| Thioglycerin | 0.4 ml |
| Glacial Acetic Acid | 3 ml |
| Water to make | 1,000 ml |
| Bleaching Solution: | |
| Water | 800 ml |
| Sodium Ethylenediaminetetraacetate (2 hydrate) | 2.0 g |
| Ammonium Ethylenediaminetetraacetato Iron (III) Complex (2 hydrate) | 120.0 g |
| Potassium Bromide | 100.0 g |
| Water to make | 1,000 ml |
| Fixing Solution: | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formalin (37% by weight) | 5.0 ml |
| Fuji Dri Well | 5.0 ml |
| Water to make | 1,000 ml |

Optical density of cyan image of the resulting sample was measured through a red filter to evaluate sensitization developability. Sensitivity was presented as a reciprocal of an exposure amount necessary to obtain a cyan density having a definite value (D: 1.0), which was determined from a characteristic curve.

The results thus obtained are shown in Table 1.

It is understood from the results of samples of the present invention (Sample Nos. 11 to 13 and 14 to 16) that width of sensitization can be controlled arbitrarily by controlling the amount of Compound I-1 and Compound I-2 (the range of 0.20 from 0.45 to 0.25 in the case of I-1, and the range of 0.18 from 0.45 to 0.27 in the case of I-2). On the other hand, in the samples for comparison and control (Sample Nos. 21 to 23, 24 to 26), the width of sensitization capable of controlling is small in the case of Compound IV-1 even if the amount is controlled (the range of 0.05 from 0.45 to 0.40), and the width of sensitization is somewhat wide in the case of VI-2 (the range of 0.09 from 0.45 to 0.36) but reduction of sensitivity by standard processing is remarkable (desensitizing from 1.00 to 0.80). As described above, the width of sensitization can be suitably controlled by using compounds represented by general formula (I) of the present invention.

TABLE 1

| Sample No. | Compound | Amount Added (g/mol Ag) | Sensitivity in Standard Processing | Sensitivity in Sensitization Processing | Width of Sensitization |
|---|---|---|---|---|---|
| 1 (Comparison) | — | — | 1.00 | 1.45 | 0.45 |
| 11 (Invention) | I-1 | 0.38 | 0.93 | 1.28 | 0.35 |
| 12 (In- | " | 0.77 | 0.89 | 1.19 | 0.30 |

TABLE 1-continued

| Sample No. | Compound | Amount Added (g/mol Ag) | Sensitivity in Standard Processing | Sensitivity in Sensitization Processing | Width of Sensitization |
|---|---|---|---|---|---|
| vention) | | | | | |
| 13 (Invention) | " | 1.15 | 0.84 | 1.09 | 0.25 |
| 14 (Invention) | I-2 | 0.38 | 0.95 | 1.32 | 0.37 |
| 15 (Invention) | " | 0.77 | 0.91 | 1.24 | 0.33 |
| 16 (Invention) | " | 1.15 | 0.86 | 1.13 | 0.27 |
| 21 (Comparison) | IV-1 | 0.50 | 0.99 | 1.42 | 0.43 |
| 22 (Comparison) | " | 1.00 | 0.99 | 1.41 | 0.42 |
| 23 (Comparison) | " | 1.50 | 0.98 | 1.38 | 0.40 |
| 24 (Comparison) | IV-2 | 0.50 | 0.96 | 1.37 | 0.41 |
| 25 (Comparison) | " | 1.00 | 0.90 | 1.28 | 0.38 |
| 26 (Comparison) | " | 1.50 | 0.80 | 1.16 | 0.36 |

Sensitivity of Sample 1 in standard processing is 1.00.

EXAMPLE 2

In Sample 1 used in Example 1, Compounds II-2 to 4 represented by general formula (II) were used as sensitizing dyes instead of II-1 in the same amount as that of II-1, and Compound I-1 was added to the third layer in an amount of 0.10 g/mol Ag to prepare samples (Samples 102 and 104). The results are shown in Table 2. A sample using a sensitizing dye represented by II-1 (Sample 101) is described in the table, too. The results obtained in samples (Samples 105 to 107) which were obtained using Compounds V-1 to 3 which were not represented by general formula (II) in the same amount as that of II-1 are shown for comparison in Table 2.

The width of sensitization in samples using II-1 to 4 is 0.42 to 0.50, which is a fairly great value as compared with the width of sensitization of 0.25 to 0.30 in the samples using V-1 to 3. Namely, Compounds II-1 to 4 expand the width of sensitization, whereby they are suitable in the present invention.

TABLE 2

| Sample No. | Kind of Sensitizing Dye | Sensitivity in Standard Processing | Sensitivity in Sensitization Processing | Width of Sensitization |
|---|---|---|---|---|
| 101 (Invention) | II-1 | 1.00 | 1.45 | 0.45 |
| 102 (Invention) | II-2 | 0.98 | 1.41 | 0.43 |
| 103 (Invention) | II-3 | 0.98 | 1.48 | 0.50 |
| 104 (Invention) | II-4 | 0.95 | 1.37 | 0.42 |
| 105 (Comparison) | V-1 | 0.97 | 1.27 | 0.30 |
| 106 (Comparison) | V-2 | 0.96 | 1.21 | 0.25 |
| 107 (Comparison) | V-3 | 0.96 | 1.26 | 0.30 |

Sensitivity of Sample 101 in standard processing is 1.00.

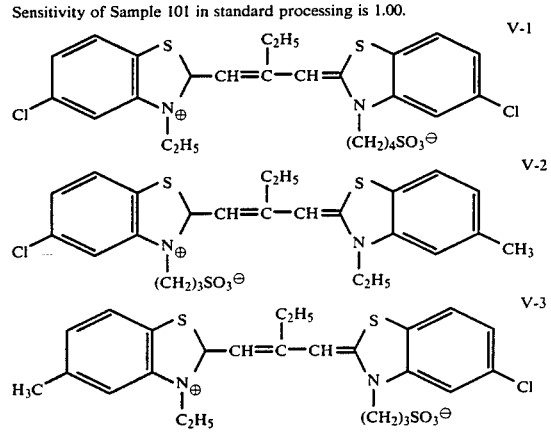

EXAMPLE 3

A double jet type silver iodobromide emulsion containing 4.0% by mol of iodine ion was prepared in the following manner.

In a reactor kept at 60° C., water (1,000 cc), inactive gelatin (25 g), potassium iodide (4 g) and potassium bromide (10 g) were allowed to exist and the mixture was continuously stirred.

To this reactor, a solution containing 100 g of silver nitrate dissolved in 300 cc of water and a solution containing 85 g of potassium bromide dissolved in 250 g of water were continuously added over 36 minutes. During addition, namely, after a lapse of 18 minutes from the start of addition, 1.2 ml of a 0.001 mol solution of tetrachloroauric acid was added. After conclusion of addition of the solution of silver nitrate and the solution of potassium bromide, the emulsion was solidified by cooling and washed with water by a noodle method to remove soluble substances.

Then, pAg was adjusted to 9.0 with a 1 mol solution of potassium bromide. The temperature of the reactor was kept at 60° C. and a 0.01 mol solution of sodium dithiosulfite aurate (I) was added in an amount of 9 ml/kg emulsion to carry out ripening for 30 minutes.

To the resulting silver iodobromide emulsion having an average particle size of 0.6 μm, potassium iodide was added in an amount shown in Table 3, a sensitizing dye represented by II-1 was added in an amount of $5\times10^{-4}$ mol/mol Ag, and a compound represented by III-17 was added as a supersensitizing agent in an amount of $2\times10^{-5}$ mol/mol Ag to absorb these compounds in the grains.

This emulsion was used instead of the emulsion of the third layer in Sample 1 used in Example 1, and Compound I-1 was added to the same layer in an amount of 0.38 g/mol Ag to prepare Samples 201 to 204. Exposure, development and measurement were carried out in the same manner as in Example 1.

It is understood that good results are obtained in systems comprising a combination of I-1, II-1 and III-17 as shown in Table 3, wherein sensitivity increases by addition of potassium iodide. It has been already described in Example 1 that the width of sensitization can be controlled arbitrarily in the systems comprising I-1, II-1, III-17 and potassium iodide added. Accordingly, in the case of adding I-1, II-1, III-17 and potassium iodide, good results were obtained, namely, the sensitivity was high and the width of sensitization could be controlled arbitrarily.

TABLE 3

| Sample No. | Amount of Potassium Iodide Added (mol/mol Ag) | Sensitivity in Standard Processing |
|---|---|---|
| 201 | — | 1.00* |
| 202 | $1.00 \times 10^{-4}$ | 1.06 |
| 203 | $5.20 \times 10^{-4}$ | 1.10 |
| 204 | $8.00 \times 10^{-4}$ | 1.05 |

*Sensitivity of Sample 201 in standard processing was 1.00.

While the invention has been described in detail and with reference to specific embodiments thereof, it will be apparent to one skilled in the art that various changes and modifications can be made therein without departing from the spirit and scope thereof.

What is claimed is:

1. Silver halide color light-sensitive material which contains a compound having a repeating unit represented by general formula (I) and a compound represented by general formula (II):

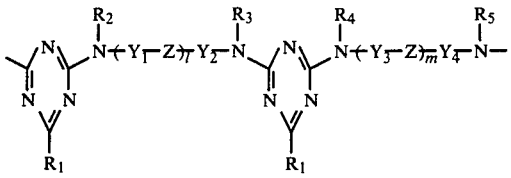

(I)

wherein $R_1$ represents —OR, —SR or

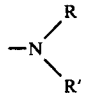

wherein R and R′ each represents a hydrogen atom, an alkyl group, a hydroxylalkyl group, a sulfoalkyl group (or a salt thereof), a carboxyalkyl group (or a salt thereof), an aralkyl group, an aryl group, or a cycloalkyl group, or R and R′ may be bonded to form an akylene ring or an —O— containing alkylene ring; $R_2$, $R_3$, $R_4$ and $R_5$ each represents a hydrogen atom or an alkyl group; $Y_1$, $Y_2$, $Y_3$ and $Y_4$ each represents a polymethylene group, an arylene group or a cycloalkylene group; Z represents —O—, —$SO_2$— or —$CH_2$—; and l and m each represents 0 or 1;

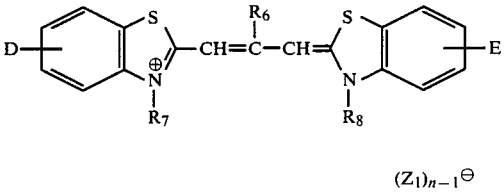

(II)

wherein $R_6$ represents a hydrogen atom or an alkyl group; $R_7$ and $R_8$, which may be identical or different, each represents an alkyl group or an aryl group, but at least one of $R_7$ and $R_8$ is an alkyl group having an acid substituent; D and E, which may be identical or different, each represents a hydrogen atom, a halogen atom, an alkyl group, a hydroxyl group, an alkoxy group, an acyl group, an acyloxy group, an alkoxycarbonyl group, a carbamoyl group, a sulfamoyl group, a cyano group, a carboxyl group, a sulfo group, a trifluoromethyl group, a phenyl group or a benzene condensed ring, but at least one of D and E represents a hydroxyl group, an alkoxy group, an alkoxycarbonyl group or a carboxyl group; $Z_1$ represents an anion; and n represents 1 or 2, but n represents 1 when the dye forms an inner salt.

2. The silver halide color light-sensitive material as claimed in claim 1, wherein emulsion grains in the silver halide color light-sensitive material are surface low iodine type silver iodobromide grains in which iodine ion in an amount of $10^{-7}$ to $10^{-2}$ mol per mol of silver halide is incorporated into the surface or subsurface area to a depth of 200 Å by absorption or halogen conversion.

3. The silver halide color light-sensitive material is claimed in claim 1, wherein the alkyl group represented by R or R′ has 1 to 12 carbon atoms, the hydroxyalkyl group, the sulfoalkyl group and the carboxyalkyl group each represented by R or R′ have 1 to 12 carbon atoms in the respective alkyl moiety, the aryl group represented by R or R′ has 6 to 12 carbon atoms and is unsubstituted or substituted with a sulfo group or a salt thereof, a carboxyl group or a salt thereof, an alkyl group having 1 to 4 carbon atoms, an alkoxy group having 1 to 4 carbon atoms or a halogen atom, the alkyl group represented by $R_2$, $R_3$, $R_4$ or $R_5$ has 1 to 4 carbon atoms, the polymethylene group represented by $Y_1$, $Y_2$, $Y_3$ or $Y_4$ has 2 to 12 carbon atoms and is unsubstituted or substituted with an alkyl group having 1 to 4 carbon atoms, and the arylene group represented by $Y_1$, $Y_2$, $Y_3$ or $Y_4$ is unsubstituted or substituted with a sulfo group or a salt thereof, a carboxyl group or a salt thereof, an alkyl group having 1 to 4 carbon atoms or a halogen atom.

4. The silver halide color light-sensitive material as claimed in claim 1, wherein $R_6$ represents a hydrogen atom, an unsubstituted alkyl group having 6 or less carbon atoms, or a substituted alkyl group; $R_7$ and $R_8$, which may be identical or different, each represents an unsubstituted alkyl group having 12 or less carbon atoms or a substituted alkyl group, but at least one of $R_7$ and $R_8$ has a sulfo group or a carboxyl group; D and E, which may be identical or different, each represents a hydrogen atom, a halogen atom, and an alkyl group having 6 or less carbon atoms, a hydroxyl group, an alkoxycarbonyl group having 8 or less carbon atoms, an acyl group having 8 or less carbon atoms, an acyloxy group having 8 or less carbon atoms, an alkoxy group having 8 or less carbon atoms, a carbamoyl group or a substituted carbamoyl group having 6 or less carbon atoms, a sulfamoyl group or a substituted sulfamoyl group having 6 or less carbon atoms, a cyano group, a carboxyl group, a sulfo group, a trifluoromethyl group, a phenyl group or a benzene condensed ring, but at least one of D and E represents a hydrogen atom, an alkoxy group, an alkoxycarbonyl group or a carboxyl group; $Z_1$ represents an anion selected from a halogen ion, a perchlorate ion, a tetrafluoroborate ion, a p-toluenesulfonate ion, a p-chlorobenzenesulfonate ion, an ethylenesulfonate ion or a thiocyanate ion.

5. The silver halide color light-sensitive material as claimed in claim 1, wherein the compound having a repeating unit represented by general formula (I) is present in a silver halide emulsion layer in an amount of 0.01 to 50 g per mol of silver.

6. The silver halide color light-sensitive material as claimed in claim 1, wherein the compound having a repeating unit represented by general formula (I) is present in a protective layer or an intermediate layer in an amount of 0.05 to 250 g per kg of gelatin.

7. The silver halide color light-sensitive material is claimed in claim 1, wherein the compound represented by general formula (II) is present in a silver halide emulsion layer in an amount of $1\times10^{-5}$ to $2\times10^{-3}$ mol per mol of silver.

8. The silver halide color light-sensitive material as claimed in claim 1, wherein the compound having a repeating unit represented by general formula (I) is present in the same emulsion layer as that sensitized with the compound represented by general formula (II).

9. The silver halide color light-sensitive material as claimed in claim 1, additionally containing a compound represented by general formula (III):

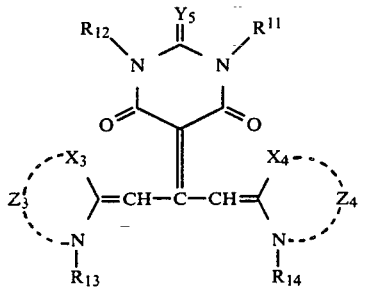

(III)

wherein $Y_5$ represents an oxygen atom or a sulfur atom; $X_3$ and $X_4$ each represents a sulfur atom or a selenium atom; $Z_3$ and $Z_4$ each represents a non-metal atomic group necessary to form a benzene ring or a naphthalene ring; $R_{11}$ and $R_{12}$ each represents an alkyl group having 6 or less carbon atoms, or an alkyl group having 6 or less carbon atoms which is substituted with an alkoxy group having 1 to 4 carbon atoms, a chlorine atom, a fluorine atom or a phenyl group; and $R_{13}$ and $R_{14}$ each represents an alkyl group having 10 or less carbon atoms or an alkyl group having 6 or less carbon atoms which is substituted with a sulfo group, a hydroxyl group, a carboxyl group, a carbamoyl group, a sulfophenyl group, a carboxyphenyl group or a halogen atom.

10. The silver halide color light-sensitive material as claimed in claim 9, wherein the compound of general formula (III) is represented by general formula (III-A) or (III-B):

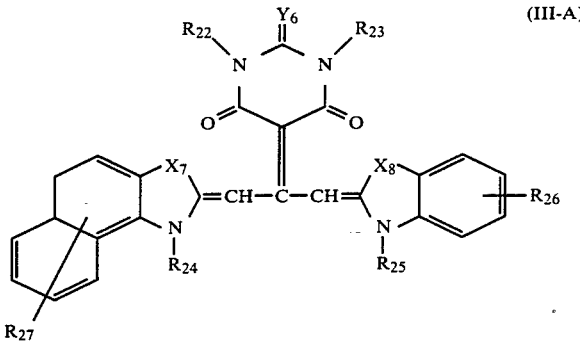

(III-A)

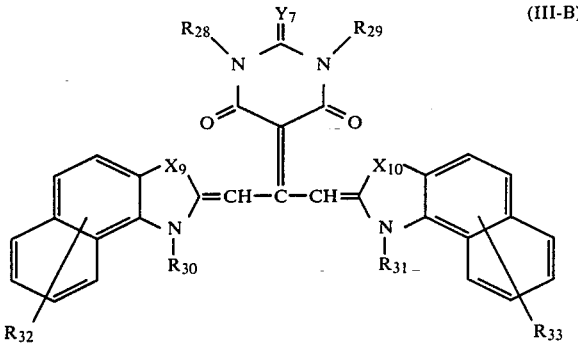

(III-B)

wherein $Y_6$ and $Y_7$ each represents an oxygen atom or a sulfur atom; $R_{22}$, $R_{23}$, $R_{28}$ and $R_{29}$, which may be the same or different, each represents a lower alkyl group having 1 to 6 carbon atoms which may be substituted with a lower alkoxy group having 1 to 4 carbon atoms, a chlorine atom, a fluorine atom or a phenyl group; $R_{24}$, $R_{25}$, $R_{30}$ and $R_{31}$ each represents a sulfoalkyl group having 2 to 4 carbon atoms, a carboxyalkyl group having 2 to 5 carbon atoms, a hydroxylalkyl group having 2 to 6 carbon atoms, an alkyl group having 2 to 5 carbon atoms and substituted with an unsubstituted carbamoyl group, or a lower alkyl group having 6 or less carbon atoms which may be substituted with a fluorine atom, a chlorine atom, an alkoxy group having 1 to 4 carbon atoms, a phenyl group or a sulfophenyl group; $R_{26}$, $R_{27}$, $R_{32}$ and $R_{33}$, which may be the same or different, each represents a hydrogen atom, a chlorine atom, a bromine atom, a lower alkyl group having 1 to 7 carbon atoms, a lower alkoxy group having 1 to 6 carbon atoms, a carboxyl group, a hydroxyl group, an alkoxycarbonyl group having a total of 2 to 5 carbon atoms, an acylamino group having 2 to 5 carbon atoms in the acyl moiety, or a phenyl group which may be substituted with a chlorine atom, a bromine atom, an alkyl group having 4 or less carbon atoms or an alkoxy group having 4 or less carbon atoms; and $X_7$, $X_8$, $X_9$ and $X_{10}$, which may be the same or different, each represents a sulfur atom or a selenium atom.

11. The silver halide color light-sensitive material as claimed in claim 9, wherein the amount of the compound represented by general formula (III) is in the range of 1/5 to 1/200 of the compound represented by general formula (II) in a mol ratio.

* * * * *